United States Patent [19]

Hirabayashi et al.

[11] Patent Number: 4,640,600

[45] Date of Patent: Feb. 3, 1987

[54] FIXING DEVICE

[75] Inventors: Hiromitsu Hirabayashi; Masaaki Sakurai, both of Yokohama, Japan

[73] Assignee: Canon Kabushiki Kaisha, Tokyo, Japan

[21] Appl. No.: 541,071

[22] Filed: Oct. 12, 1983

[30] Foreign Application Priority Data

| | | | |
|---|---|---|---|
| Oct. 15, 1982 | [JP] | Japan | 57-181815 |
| Oct. 20, 1982 | [JP] | Japan | 57-183995 |
| Jan. 8, 1983 | [JP] | Japan | 58-1561 |
| Jul. 6, 1983 | [JP] | Japan | 58-123706 |
| Jul. 8, 1983 | [JP] | Japan | 58-125075 |

[51] Int. Cl.[4] ..... G03G 15/20

[52] U.S. Cl. ..... 355/3 FU; 219/216; 219/470; 355/14 FU; 432/60

[58] Field of Search ..... 355/3 R, 3 FU, 14 FU; 219/216, 469, 470, 471; 432/60

[56] References Cited

U.S. PATENT DOCUMENTS

| | | | |
|---|---|---|---|
| 4,045,164 | 8/1977 | Moser | 355/3 FU X |
| 4,083,092 | 4/1978 | Imperial et al. | 355/3 FU X |
| 4,083,322 | 4/1978 | Beckman | 355/3 FU X |
| 4,185,140 | 1/1980 | Strella et al. | 355/3 FU |
| 4,324,482 | 4/1982 | Szlucha | 355/3 FU |
| 4,393,804 | 7/1983 | Nygard et al. | 355/3 FU X |

*Primary Examiner*—Fred L. Braun

*Attorney, Agent, or Firm*—Fitzpatrick, Cella, Harper & Scinto

[57] ABSTRACT

A fixing device includes a first rotatable member and a second rotatable member for gripping and transporting a recording material to fix a material to be fixed having a predetermined electric polarity onto the recording material, the first rotatable member being positioned to be contacted with the face of the recording material bearing the material to be fixed, and the second rotatable member to be contacted with a back face of the recording material, and at least one of the first and second rotatable members having a surface applied with an electrification agent for generating electric charge through friction with recording material for formation of an electrical field for attaching the material to be fixed onto the recording material.

40 Claims, 33 Drawing Figures

FIG. 28A

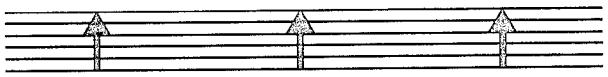

We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison with conventional electrophotographic system already on the market, the CANON NP System offers many superior features and a wide range of application. We call our NP system the third system in electrophotography. Always guarantees sharp and Clear images. Completely dry copies. Uses ordinary paper. High sensitivity,

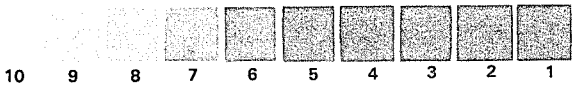

おまかせください．ランニングコストも驚くほど安く，事務の合理化にもお役にたちます．キヤノンの精密光学技術，事業機械製造技術のすぐれた経験がいきている電子複写機です．キヤノン独自の開発キヤノンＮＰシステムは第三の電子写真方式です．どんな原稿，どんな色からもいつも純黒調のきれいなコピ

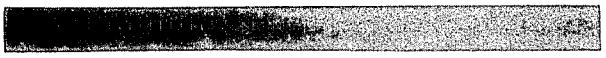

We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison with conventional electrophotographic system already on the market, the CANON NP System offers many superior features and a wide range of application. We call our NP system the third system in electrophotography. Always guarantees sharp and Clear

CANON TEST SHEET-NA2

CUSTOMER :_____

MODEL :_____ SERIAL NO. :_____

DATE :_____ EXPOSURE SETTING :_____

COUNTER READING :_____

COPY MADE ☐BEFORE ☐AFTER ADJUSTMENT (CHOOSE ONE)

電子写真方式です．どんな原稿，どんな色からもいつも純黒調のきれいなコピ

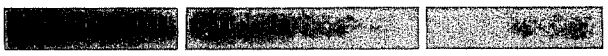

We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low

FIG. 28B

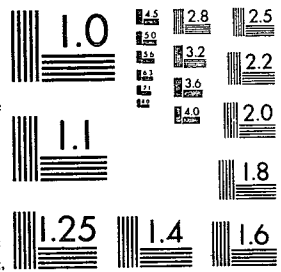

running cost. In
already on the
features and a
third system in e
images. Comple
high contrast, hi
effect. High eco
キヤノン独自の開
原稿，どんな色か
に完全にドライな
ーです．変色，褪
ディに伝える方法，
tographic system
s many superior
NP system the
sharp and Clear
High sensitivity,
tion of the edge
t. In comparison
方式です．どんな
れます．普通の紙
トの格調高いコピ
たの意志をスピー
の電子式複写機に
おまかせください．ランニングコストも驚くほど安く，事務の合理化にもお役
にたちます．キヤノンの精密光学技術，事業機械製造技術のすぐれた経験がい
きている電子複写機です．キヤノン独自の開発キヤノンＮＰシステムは第三の
電子写真方式です．どんな原稿，どんな色からもいつも純黒調のきれいなコピ
ーが得られます．普通の紙に完全にドライなコピーがとれます．高感度，高コ
ントラストの格調高いコピーです．変色，褪色もなく保存は永久的です．誤解

We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison with conventional electrophotographic system already on the market, the CANON NP System offers many superior features and a wide range of application. We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison
キヤノン独自の開発キヤノンＮＰシステムは第三の電子写真方式です．どんな
原稿，どんな色からもいつも純黒調のきれいなコピーが得られます．普通の紙
に完全にドライなコピーがとれます．高感度，高コントラストの格調高いコピ

FIG. 28C

ーです．変色，褪色もなく保存は永久的です．誤解なくあなたの意志をスピー
ディに伝える方法，それはＮＰシステムを応用したキヤノンの電子式複写機に
おまかせください．ランニングコストも驚くほど安く，事務の合理化にもお役
にたちます．キヤノンの精密光学技術，事業機械製造技術のすぐれた経験がい
きている電子複写機です．キヤノン独自の開発キヤノンＮＰシステムは第三の

We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison with conventional electrophotographic system already on the market, the CANON NP System offers many superior features and a wide range of application. We call our NP system the third system in electrophotography. Always guarantees sharp and Clear images. Completely dry copies. Uses ordinary paper. High sensitivity, high contrast, high quality. Fine eradation and elimination of the edge effect. High economy in copy making and low running cost. In comparison
キヤノン独自の開発キヤノンＮＰシステムは第三の電子写真方式です．どんな

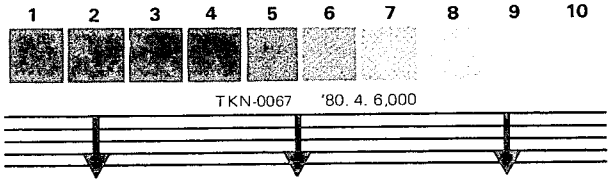

FIXING DEVICE

BACKGROUND OF THE INVENTION

1. Field of the Invention

This invention relates to an image fixing device to be used with a recording apparatus such as electrophotographic apparatus, electrostatic recording apparatus and others, more particularly to an image fixing device in which a rotatable member is used for heating treatment, pressurizing treatment or heating and pressurizing treatment for fixing a material to be fixed such as unfixed images onto a recording material.

2. Description of the Prior Art

In an image fixing device for an image forming apparatus in which unfixed images are fixed on plain paper, use has been frequently made of a system in which a fixing roller and a heating roller grip and transport a recording material such as plain paper.

Generally speaking, when a recording material (e.g. paper) supporting electrostatically an image formed with toner charged to positive or negative polarity is to be subjected to contact fixing, there will occur an off-set phenomenon, in which toner particles for forming toner images are deposited on a rotatable member such as roller or belt. In the prior art, for prevention of this phenomenon, a parting or releasing layer (comprising tetrafluoroethylene or silicone rubber) or a parting or releasing liquid (e.g. silicone oil) was formed on the surface of a rotatable member, but its preventing effect was insufficient. In addition to this, proposals for improvement are disclosed in Japanese Laid-open Patent Application Publication No. 55374/1980 (U.K. Patent Application GB No. 2035901 A) and Japanese Laid-open Patent Application Publication No. 96970/1980. According to one of these methods, a bias voltage of the same polarity as that of toner is applied externally on the rotatable member contacted with the toner image, while according to the other method, a bias voltage of the opposite polarity to that of toner is applied on the roller on the opposite side of the recording material bearing the toner image. Whereas, when the bias voltage is applied by means of a corona charger such as Corotoron, the device is made not only physically larger and more complicated to result in higher cost, but also arc discharging or leak will tend to occur when the corona charger is contaminated. Thus, such a corona charger was unsatisfactory in reliability and safety. On the other hand, application by means of a bias roll can give only a practically small effect, and the bias roll was also impractically susceptible to contamination.

Further, when fixing is performed by pressure contacting a roller under a high pressure and at a relatively high speed, solution of the problems is not possible according to the method of the prior art, but such an operation will increase the force for permitting the toner to be offset. Such a force is liable to cause a complicated change in electrical field. Accordingly, the effect of preventing offset will become unpredictable. The device with such a great consumption of high voltage power requires excessive power, within an already limited range of power, in addition to the power already required for fixing driving, exposure lamp, etc. as well as for heaters, and therefore a number of restrictions must therefore be imposed on the other devices.

Moreover, in the device of the prior art, not only the offset preventing effect was unpredictable, but also the toner image may sometimes suffer from scattering of toner which results in a disturbed image. Accordingly, when secondary copying (a copy of a copy of an original) was repeated several times, the images were frequently shapeless.

SUMMARY OF THE INVENTION

An object of the present invention is to overcome the problems of the prior art as described above by minimizing the offset of a material to be fixed on a recording material onto the surface of a rotatable member for fixing and to stabilize its effect for a long period of time.

Another object of the present invention is to provide a sharp fixed image by prevention of a material to be fixed charged to a certain polarity from being fixed under disturbed state on a recording material.

Still another object of the present invention is to provide an offset prevention effect superior to that of the prior art and sharpness of the fixed image with a simple device, without excessive power consumption and at low cost.

Still another object of the present invention is to solve the problems in a fixing device when a rotatable member exhibiting high electrification because of a high speed, high pressure or a relatively thick electrically insulating surface is contacted with the surface of a recording material on the side opposite to the surface bearing a material to be fixed.

Further objects of the present invention will be understood from the following description.

BRIEF DESCRIPTION OF THE DRAWINGS

FIG. 28A, FIG. 28B and FIG. 28C each show a sample pattern for the original used for preparation of the photographic data in FIG. 11 to FIG. 27;

DESCRIPTION OF THE PREFERRED EMBODIMENTS

General Description

The present inventors have discovered that generation of offset depends rather on formation of triboelectrical charge potential by contact and separation charge than on agglomerating force of toner or tack between the toner and the roller contacted with the toner. In view of this point, the present inventors have made a number of experiments and extensive studies to find out a theory as hereinafter described and also a way to put such a theory into practice.

Figure 1:
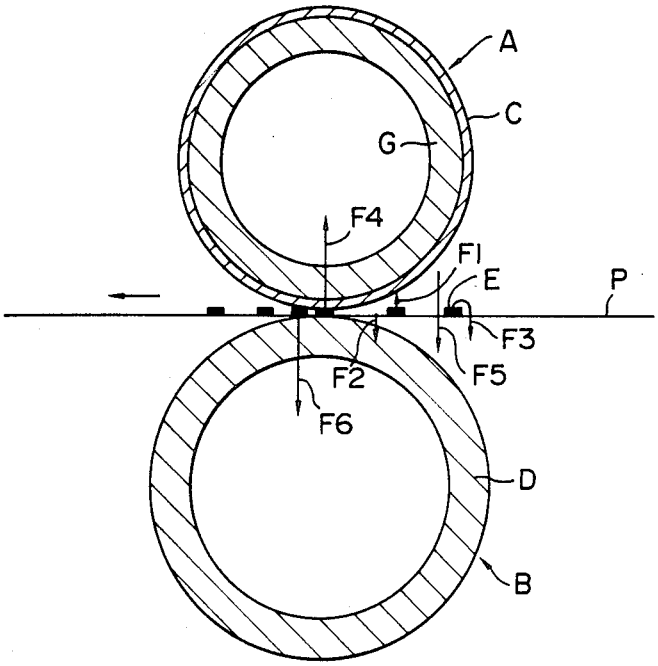
FIG. 1 shows a schematic drawing for illustration of offset generation concerning the present invention.

More specifically, the basic theory is first to be described in detail based on FIG. 1.

Referring now genera-ly to a material to be fixed E, such as a toner image T or a resin material for coating which is charged to a predetermined polarity, and to a rotatable member A, B, the acting forces on such a material to be fixed may be classified broadly into:

the resultant force $\vec{FA}$ of tack $\vec{F1}$ acting between the first rotatable member A in contact with the material to be fixed E and the material to be fixed, agglomerating force $\vec{F2}$ between the components constituting the material to be fixed E, tack $\vec{F3}$ acting between the material to be fixed E and the recording material P; and the electrostatic resultant force $\vec{FB}$ of electrostatic force $\vec{F4}$ acting between the material to be fixed E and the first rotatable member A, electrostatic force $\vec{F5}$ acting between the material to be fixed E and the recording material P and electrostatic force $\vec{F6}$ acting between the material to be fixed and the second rotatable member B contacted with the recording material P on the side not contacted with the material to be fixed E. The major cause for offset generation lies for the most part in the electrostatic resultant force $\vec{FB}$ which is caused by the potential resulting from the triboelectric charge mutually produced between the material to be fixed, the first and the second rotatable members and the recording material.

Accordingly, if the overall force of the triboelectric charged potential comprising primarily the electrostatic resultant force $\vec{FB}$ has a positive component force which urges the material to be fixed toward the second rotatable member, generation of offset can be prevented to a great extent.

And, since the overall force may be deemed to be equivalent to the resultant electrostatic force $\vec{FB}$, the specific feature of the present invention resides, in order to bring the electrostatic force $\vec{FB}$ under appropriate conditions, in applying an electrification agent to at least one of the rotatable members A and B and utilizing, for prevention of offset, triboelectric charging with the recording material.

Further, for improvement of the offset prevention effect, an electrification agent may be applied to the first rotatable member or the second rotatable member so that the overall force FC of the above-mentioned resultant force $\vec{FA}$ and electrostatic resultant force FB has a positive component force which urges the material to be fixed toward the second rotatable member. As such an electrification agent, it is suitable to use a charge controllable parting agent exhibiting non-tackiness and charging-polarity property appropriate for prevention of offset.

The charge controllable parting agent can itself exhibit non-tackiness and charging characteristics, and it is suitable of course for coating onto the surface of a rotatable member, and also for impregnation or immersion into the surface of a rotatable member.

According to some specific embodiments, (1) an electrification agent having negative charging characteristics is applied to the first rotatable member in the case of a negatively charged material to be fixed; (2) an electrification agent having positive charging characteristics is applied to the second rotatable member in the case of a negatively charged material to be fixed; (3) an electrification agent having positive charging characteristics is applied to the first rotatable member in the case of a positively charged material to be fixed; (4) an electrification agent having negative charging characteristics is applied to the second rotatable member in the case of a positively charged material to be fixed; (5) an electrification agent chargeable to the polarity opposite to that of the paper is applied to the second rotatable member so as to enhance the potential of a recording paper, when the potential of the second rotatable member is lower than several times the potential of the recording paper, or when the fixing speed is low; and there are also other combinations similar to these.

Particularly when the second rotatable member B is more readily charged to higher potential than the first rotatable member A, for example, when the surface charging layer D of the rotatable member B has a thickness greater than that of the surface charging layer C of the rotatable member A (G is a core metal), offset can be prevented to a considerable extent by applying the method according to the above item (2) or (4) wherein the charge polarity of the second rotatable member is made opposite to that of the material to be fixed.

As the device for which the item (2) or (4) can be effectively applied, there may be generally included a device in which the surface of the second rotatable member can be charged to a high potential (1000 V or higher). Charging will more readily occur and the potential of charging will tend to be elevated, as the speed of rotation is higher, or as the nip where the first and second rotatable members are press-contacted is increased in area, or as the thickness of the surface charging layer D is greater, or as the pressure between the first and the second rotatable member is increased. Most of the ordinarily practiced fixing devices satisfy these conditions, whereby the second rotatable member is charged to a high potential. Thus, in the present invention, by applying an electrification agent to the second rotatable member as shown in the item (2) or (4), the second rotatable member has been permitted to be endowed with a force attracting strongly the material to be fixed toward the recording material, whereby offset and disturbance of the material to be fixed could be prevented.

The term "apply" used in the present invention means comprehensively covers the actions of (1) impregnation or immersion of a rotatable member and (2) coating (direct, or by a coating member, or through another rotatable member).

The present invention can elongate the service life of a rotatable member for fixing through the effect of preventing offset which may otherwise be caused by triboelectric charging, thus realizing saving of sources and decrease in the total cost.

EXAMPLES AND DESCRIPTIONS THEREOF

Referring now to the specific examples based on the above general description, the present invention is further illustrated with reference to the drawings and the photographs.

Figure 2:
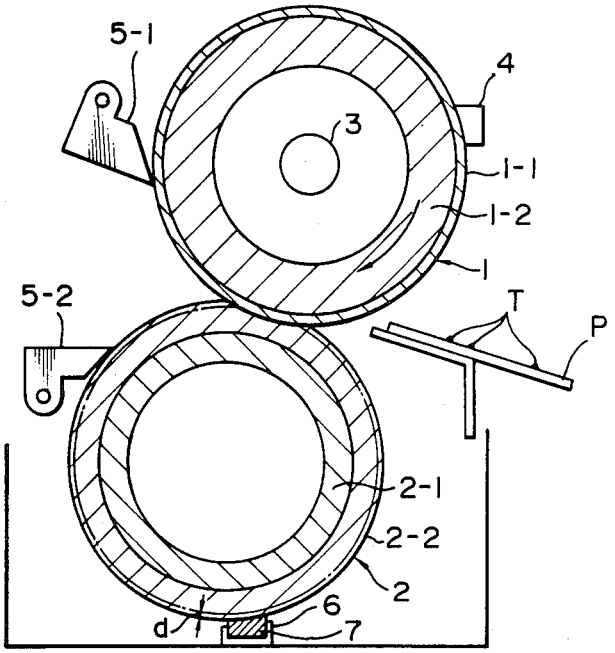
FIG. 2 and FIG. 3 each show a sectional view of the embodiment of the present invention.
Figure 3:
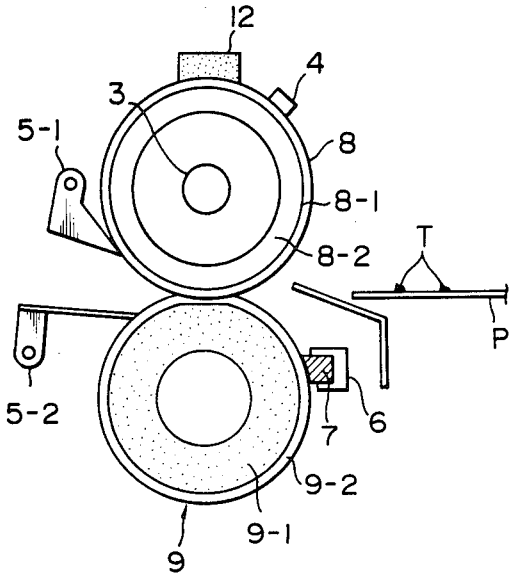

(1) In the following, there are shown examples of a roller for fixing which is to be applied or already applied with an electrification agent in order for a material to be fixed to be attached to the recording material, or a fixing device having such a roller, in the case when a material to be fixed such as toner image or a resin member is charged to a predetermined polarity.

a. FIG. 2 and FIG. 3 show examples in which the rotatable member is coated on its surface with an electrification agent for charging positive through friction with plain paper.

EXAMPLE 1

FIG. 2 shows an embodiment in which the toner image T formed by electrophotographic process is fixed by means of heat fixing device on the plain paper P.

The fixing device has a fixing roller 1 having internally a heater 3 for heating such as a halogen heater, and it rotates in the direction of the arrow by receiving the driving force from a driving motor (not shown); a pressurizing roller 2 which rotates frictionally with pressure contact against the fixing roller 1. The fixing roller 1 consists of a hollow roller core 1-2 made of a metal such as aluminum stainless steel or copper and heat-resistant resin layer 1-1 with parting characteristic such as of tetrafluoroethylene resin with a thickness of 20 to 100$\mu$ provided on the outer circumferential surface. The pressure roller 2 is supported rotatably on a bearing (not shown). The roller 2 is pressure contacted against the fixing roller 1 by a known pressuring means at least during fixing, and it consists of a metallic roller core 2-1 and an insulating elastomer layer 2-2 such as of silicone rubber, fluorine rubber, or fluorosilicone rubber with a relatively thick thickness (about 5 to 10 mm) provided on the outer circumferential surface. This structure is adopted with the view to ensuring the sufficient pressure contact region with the fixing roller. On the fixing roller 1 is arranged a thermosensitive element 4 such as thermistor or thermocouple in contact therewith, and its detection signal is led to a known controlling means (not shown) to maintain the temperature at the outer circumferential surface of the fixing roller 1 at the melting point of the toner image (by controlling the output of the heater 3 or the application voltage therefor).

Separation pawls 5-1 and 5-2 are provided for separating the recording materials assuredly from the rollers. A heat-resistant unwoven fabric 7 impregnated with an electrification agent is provided, and when the pressurizing roller 2 is not heated by the heater 3, it is positioned apart from the pressurizing roller (or pressure roller) surface with a distance d therefrom, which is maintained by a supporting member. When copying switch is turned on, the fixing roller begins to rotate with concomitant pressure contact rotation of the pressure roller 2. As the progress of rotation, the insulating elastomer layer of the pressure roller 2 will be so expanded by the heat from the fixing roller 1 as to be contacted to the heat-resistant unwoven 7 fabric impregnated with an electrification agent, whereby the electrification agent will be applied onto its surface. After completion of copying, the pressure roller 2 will release its heat spontaneously and contract to be apart from the heat-resistant unwoven fabric 7. By way of such a fixing, thermal deterioration of the electrification agent could be minimized.

The electrification agents to be employed in this Example have the following chemical formulae:

I. Fatty acid monoethanol amide:

$$R—CO—NH—CH_2CH_2OH$$

For example, R may be $C_{11}$–$C_{17}$, hydrocarbon residue of fatty acids, e.g. lauryl group.

II. Fatty acid diethanolamide:

$$R—CO—NH\begin{matrix} \diagup CH_2CH_2OH \\ \diagdown CH_2CH_2OH \end{matrix}$$

For example, R may be $C_{11}$–$C_{17}$, hydrocarbon residue of fatty acids, e.g. lauryl group.

By the effect of the electrification agent, the pressure roller 2 is charged positively through friction with the plain paper and the fixing roller 1.

In the fixing device having the constitution as shown above, a pair of rollers each having an outer diameter of 60 mm were pressure contacted with each other under a total pressure of 60 kg, and copying operation was performed at a speed of 23 sheets of A3 size sheets/min. (roller circumferential speed 270 mm/sec.) When a negatively charged toner (negative toner) was employed and 300 mg of the toner per one sheet of the A3 plain paper was fixed, the off-set was reduced to 1/15 or less in the case of the electrification agent of I, and 1/20 or less in the case of the electrification agent of II, as compared with the case when no such electrification agent as mentioned above was coated or supplied.

In addition, the pressure roller potential after paper passage was +4000 V for the electrification agent I and +45000 V for the electrification agent II, thus exhibiting clearly the remarkable effect of the electrification agent, as compared with −6000 V in the case when none of the above electrification agents are given at all. This phenomenon may be speculated as follows. When a positive latent image is developed with a negative toner and transferred onto a plain paper, positive charges are given to the plain paper and the image transfer is effected through the electrostatic attracting force to the negative toner. Thus, at this point, it is important that the plain paper should be charged to the positive polarity. The above effects of the electrification agent would seem to contradict this, because the charging of the pressure roller 2 surface to the positive polarity by the friction with the paper results in the paper being charged to the negative polarity, correspondingly. That is, the resultant charge of the paper is opposite to the polarity given by the transfer charger.

However, the present inventors have found that the fact is that the off-set is concerned rather with potential than with the amount of charges. That is, what is important is not the polarities of the charges of the paper or the pressure roller 2, but it is the surface potential resulting from those charges. Keeping this in mind, it should be noted that, on the same level of the charges given and taken, the pressure roller 2 having a smaller capacitance than the paper will have an influence on the potential by far greater than that of paper, which potential creates a great force on the negative toner on the plain paper.

Next, for investigation of persistency of the above effect, a heat-resistant unwoven fabric of 10 mm in width and 2 mm in thickness was provided over the total length (320 mm) of the pressure roller, and, with the heat-resistant unwoven fabric impregnated with 10 cc of methyl silicone oil containing 3% of the electrification agent I, under the above conditions, intermittent copying of 10,000 was performed on one sheet per minute basis. As the result, it could be confirmed that there was the same effect as described above even after copying of 10,000 sheets.

Also, when the pressure roller was coated uniformly on its surface with 0.5 cc of methyl silicone containing 3% of the electrification agent I and the same intermittent copying as mentioned above was repeated, with the electrification agent coating members 6 and 7 as shown in FIG. 2 being removed, it was confirmed that the offset was reduced favorably to 1/12 as compared with that of the prior art even after copying of 2,000 sheets, although the effect was slightly lowered.

EXAMPLE 2

As another example, FIG. 3 shows a fixing roller according to this Example to be used in an image forming device in which various N type negative latent images are developed with a positive toner to be visualized and a fixing apparatus having such a roller.

In FIG. 3, as a fixing roller 8, there was employed a roller consisting of a stainless steel core metal 8-2 of 24 mm in diameter and 0.5 mm in thickness coated with a heat-resistant resin layer 8-1 with parting characteristic of a PFA coating layer of 30$\mu$ in thickness and, as a pressurizing roller 9, a roller of 24 mm in outer diameter consisting of an aluminum core metal of 14 mm in diameter and 4 mm in thickness covered with a silicone rubber sponge 9-1 with a sponge hardness (ASKER C) of 25, of which outer circumference is further coated with a thermovulcanizable silicone rubber coating 9-2 of 1 mm in thickness, which rollers were pressure contacted with each other under the total pressure of 5 kg, and copying was performed at a speed of roller circumferential speed of 60 mm/sec on A4 size paper.

The device includes is a heater 3, a thermistor 4, a cleaning member 12 such as Nomex, separating nails 5-1 and 5-2, a supporting member 6 and a heat resistant unwoven fabric 7 impregnated with an electrification agent applicable to this invention.

In this Example, the method for coating of the electrification agent is the same as in the foregoing Example. In this Example, the amount of offset could be reduced to $\frac{1}{3}$ or less of that of the prior art by coating of the electrification agent (the above I, II). The surface potential on the pressure roller, the potential on the copying paper and the potential on the fixing roller were found to be +800 V, −400 V and −20 V, respectively. According to this Example, in spite of the toner having plus charges, the same offset preventive effect as in the foregoing Example can be obtained. This may be ascribable to the reason that, when the pressure roller 2 is not charged by the triboelectricity or the like, the potential on the back face of the paper (opposite to the face supporting the toner) rather than the potential on the pressurizing roller has a greater influence on the toner, due to the distance between the toner and the pressure roller 2 which is farther than the distance between the paper and the toner. For example, even if the potential on the paper may be lower in absolute value than the potential on the pressure roller 2, the major influence on the toner is by the potential on the paper as the recording material, provided that the difference is not more than 3 times.

The effect of the electrification agent in this Example acts to charge the pressure roller 2 to positive polarity through friction with the paper, and conversely to negative polarity the back face of the paper. Consequently, the electrostatic attracting force is increased for the above positively charged toner. In short, by coating of the above electrification agent, a potential capable of reducing offset of the toner can be ensured on the paper face opposite to the face on which the toner is fixed.

As described above, according to these Examples 1 and 2, the surface of a rotatable member, a recording material such as paper or a material to be fixed can be maintained under stable conditions to enable prevention of offset phenomenon assuredly by a simple method of applying a positive polarity electrification agent such as an electrification agent having a fatty acid monoethanol amide or a fatty acid diethanol amide. The above Examples are effective for a fixing apparatus having a rotatable member having an insulating coating. Particularly, Example 1 is effective for a fixing apparatus with a large amount of resultant triboelectric charging at the nip portion between rollers and employing a negative toner, while Example 2 is effective for a fixing apparatus having a pressure roller with a relatively small amount of resultant triboelectric charging.

Example 1 is not limited to fixing apparatus equipped with a roller having an insulating coating and a rotatable member such as a roller or a belt, but it is preferably applied for a surface having a thick insulating coated layer.

In the embodiment of Example 1 illustrated in FIG. 2, on electrification agent of positive polarity (to be charged through friction with a recording material) was applied on the pressure roller 2 so that the pressure roller 2 may be triboelectrically charged to the positive polarity. In a fixing apparatus used with the positive toner image, an electrification agent of negative polarity may similarly be applied in order to use the same idea as with Example 1. Also, in Example 2 shown in FIG. 3, an electrification agent of positive polarity was applied on the pressure roller 2 in the case of the positive toner, but in a fixing device used with the negative toner image, an electrification agent of negative polarity may be applied on the pressure roller 2.

According to these Examples, there are shown particularly effective examples in which triboelectric charging level of the pressure roller were changed, but the vector of the resultant force may be directed toward the side of the pressurizing roller by changing the triboelectric charging level of the fixing roller thereby to charge $\vec{F4}$ and $\vec{F5}$ or $\vec{F4}$, $\vec{F5}$ and $\vec{F6}$.

It is more effective that the triboelectric charging level of that surface which is more readily charged to a high potential (e.g. a surface with great frictional coefficient) is changed.

In the constructions according to the foregoing Examples, the pressure roller is more easily charged to the high potential, due to its capacitance. Now, examples of the materials for the pressure rollers positioned positive or negative in the triboelectric charging level relative to the copying paper are set forth below. When the elastomer layer of the pressure roller is silicone rubber and a fine powder of silica is applied on its surface (preferably applied as a mixture with silicone oil), most of them will be negative relative to the paper, that is, the pressure roller will be charged negatively (accordingly, the copying paper positively) through the triboelectric charging with the copying paper.

Group 1 of Exemplary Electrification Agents

As the above-mentioned fine powder of silica, there are silica of the dry system method (fumed silica) and silica of the wet system method. Examples of the commerically available silica of the dry system method may include:

Trade names of Nippon Aerosil Co.: AEROSIL 130, 200, 300, 380, TT600, MOX80, MOX170, COK84;

Trade names of CABOT Co.: Cab-O-Sil M5, MS-7, MS-75, HS-5, EH-5;

Trade names of WACKER-CHEMIE GMBH: Wacker HDK N20, V15, N20E, T30, T40;

Trade names of Dow Corning Co.: D-C Finesilica;

Trade names of Fransil Co.: Fransol

On the other hand, commercially available silica of the wet system silica may be exemplified as follows (trade named set forth on the left side, names of selling companies on the right):

| | |
|---|---|
| Carplex | Shionogi Seiyaku |
| Nipsil | Nippon Silica |
| Tokusil, Finesil | Tokuyama Soda |
| Bitasil | Taki Seihi |
| Silton, Silnes | Miausawa Kagaku |
| Starsil | Kamishima Kagaku |
| Himezil | Ehime Yakuhin |
| Siloid | Fuji Devidson Kagaku |
| Hi-sil | Pittsburgh Plate Glass Co. |
| Durosil | Fiillstoff-Gasellschaft Marquart |
| Ultrasil | |
| Manosil | Hardman and Holden |
| Hoesch | Chemische Fabrik Hoesch K-G |
| Sil-Stone | Stoner Rubber Co. |
| Nalco | Nalco Chem. Co. |
| Quso | Philadelphia Quartz Co. |
| Santocell | Monsanto Chemical Co. |
| Imsil | Illinois Minerals Co. |
| Calcium Silikat | Chemische Fabrik Hoesch K-G |
| Calsil | Fiillstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabriken Bryer, A.-G. |
| Tufknit | Durham Chemicals, Ltd. |
| Sirmos | Shiraishi Kogyo |
| Starlex | Kamishima Kagaku |
| Fricosil | Taki Seihi |

The rotatable members such as belts or rollers coated with these fine powders of silica are all positioned at the negative orders in the triboelectric charging level relative to the paper as the recording material.

By coating of the rotatable member with the fine powder of silica as mentioned above, a great negative surface potential can be generated on said rotatable member by triboelectric charging with paper. This is effective for the pressure roller 2 opposed to positive material to be fixed or the fixing roller 1 opposed to negative material to be fixed.

Group 2 of Exemplary Electrification Agents

Silane coupling treatment:

A silane coupling agent represented by the formula:

$$RmSiYn$$

(wherein R is an alkoxy group or a chlorine atom, m is an integer of 1 to 3; Y is a hydrocarbon group having at least one kind or two or more kinds of amino group, vinyl group, glycidoxy group, mercapto group, methacryl group and ureido group, n is an integer of 3 to 1) is coated.

By application of the silane coupling treatment on the outer surface of a rotatable member, as the enhanced positive triboelectric charging is formed by friction between the rotatable member and the paper, the rotatable member is positioned to more positive order relative to the paper in triboelectric charging level.

Otherwise, a material applied with silane coupling treatment, for example, fine powder of silica (either from the dry system method or from the wet system method) applied with this treatment may be used to apply or supply a silane coupling agent on the surface of the rotatable member. For example, as the compounds having vinyl groups, there may preferably be employed:

$H_2C{=}CHSiCl_3$ $H_2C{=}CHSi(OC_2H_5)_3$ $H_2C{=}CHCH_2SiCl_3$ $H_2C{=}CHCH_2Si(CH_3)Cl_2$ $H_2C{=}CHCH_2Si(CH_3)_2Cl$ $H_2C{=}CHCH_2Si(OC_2H_5)_3$ $H_2C{=}CHSi(OC_2H_4OCH_3)_3$ $(H_2C{=}CHCH_2)_2SiCl_2$ $(H_2C{=}CH)_2Si(OC_2H_5)_2$ $(H_2C{=}CH)_3SiOC_2H_5$

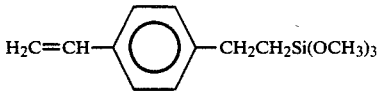

As the compound having glycidoxy group, there may be included:

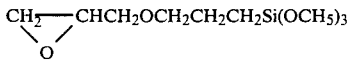

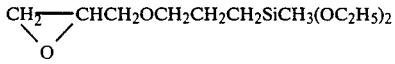

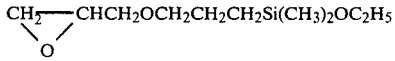

-continued

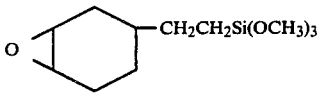

As the compound having mercapto group, there are:

$HSCH_2CH_2CH_2Si(OCH_3)_3$ $HSCH_2CH_2CH_2Si(OC_2H_5)_3$

The compound containing methacryl group may include:

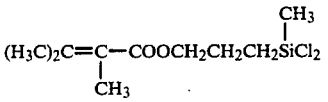

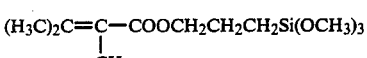

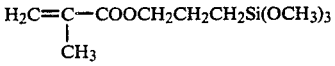

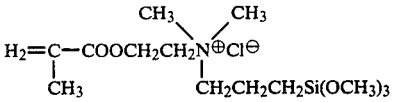

The compound having ureido group may be exemplified by:

$H_2NCONHCH_2CH_2CH_2Si(OC_2H_5)_3$

The silane coupling agents particularly preferably used in the present invention are compounds having amino group as represented by the following structural formulae:

$H_2NCH_2CH_2CH_2Si(OCH_3)_3$ $H_2NCH_2CH_2CH_2Si(OC_2H_5)_3$ $H_2NCH_2CH_2CH_2Si(OCH_3)_2$ (CH3 branch)

$H_2NCH_2CH_2NHCH_2CH_2CH_2Si(OCH_3)_2$ (CH3 branch)

$H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_5C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NH.$ $CH_2CH_2CH_2Si(OCH_3)_3$ $H_3COCOCH_2CH_2NHCH_2CH_2NHCH_2CH_2CH_2Si(OCH_3)_3$

-continued

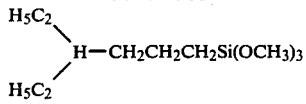

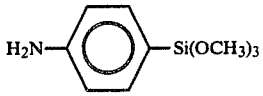

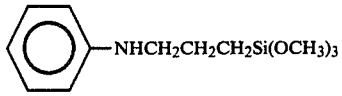

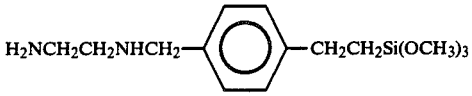

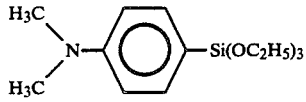

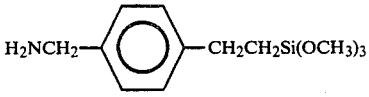

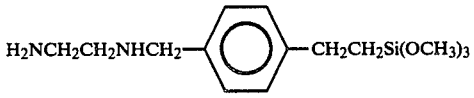

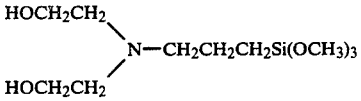

$(H_3CO)_3SiCH_2CH_2CH_2-NHCH_2$
$(H_3CO)_3SiCH_2CH_2CH_2-NHCH_2$ $(H_5C_2O)_3SiCH_2CH_2CH_2$
NH
$(H_5C_2O)_3SiCH_2CH_2CH_2$ $H_3NHCH_2CH_2CH_2Si(OC_2H_5)_3$ $H_2N(CH_2CH_2NH)_2CH_2CH_2CH_2Si(OCH_3)_3$ $H_3C-NHCONHC_3H_6Si(OCH_3)_3$

In the above compounds, the alkoxy group may be replaced by chlorine atom. These silane coupling agents may be used as a single kind or as a mixed system of two or more kinds.

As still another example, with a felt being impregnated with an electrification agent having positive characteristic such as fatty acid monoethanolamide or fatty acid diethanolamide as described above, the pressure roller can be charged positively even by applying the agent constantly or intermittently on the surface of the silicone rubber roller. By providing a pressure roller thus having a negative surface of a positive surface so that the vector of the sum of F acring on the toner may be directed constantly toward the pressure roller side by way of coating as described above, there can be obtained a stable fixing apparatus which is very small in offset.

Also, since no special voltage applying means from outisde such as corona charger or bias roller is required, reliability, safety, cost, durability, etc. could also be greatly improved.

Further, by provision of an appropriate triboelectric charging level even when it is difficult to apply the surface potential of the roller from outside, even a high potential can be easily be accomplished according to the present invention.

In the above Examples, a heat fixing apparatus capable of acting most effectively has been shown, and in that case, the offset due to great tackiness during melting of toner can be reduced extremely based on the construction and the technique as described above. Further, it is also possible to apply there Examples for a fixing apparatus in which calender treatment or coating treatment is applied, and also for a pressure fixing apparatus.

The above Examples are also preferably applied, in an apparatus in which a material to be fixed is fixed by gripping and transporting a recording material by the nip formed with two rotatable members (belts or rollers), to such a rotatable member that has a smaller capacitance C, for example, which has a thicker insulating layer in the case of rotatable members having the same diameters and equal dielectric constants, in other words, it is preferably applied to the rotatable member more readily charged to a high potential, and also it is preferable to apply to the side of the rotatable member which is not directly contacted with the toner image.

EXAMPLE 3

The following description concerns an example with a modified construction with respect to the pressure roller 2 which is one of the rotatable members for fixing in the constitution of FIG. 3. The example shown below is an example in which a positive or negative electrification agent is incorporated by coating on the outer surface of the roller 2 for fixing.

This example is characterized by use of a polarity-changing electrification agent which alters the characteristics of a rotatable member, that is the characteristics to be triboelectrically charged negatively as in the case of a rubber roller is changed to the one to be triboelectrically charged positively. Its example is shown below, and the essential point resides in application of a surface treatment with a polarity-changing electrification agent such as the silane coupling agent as mentioned above on the surface of a rotatable member which has the characteristics having adverse influences, in order to prevent offset of a material to be fixed such as toner.

This Example is also based on effective utilization of $\vec{F5}$ and $\vec{F6}$ among the above-mentioned electrostatic forces for prevention of offset.

A method for preparation of a roller applicable for this Example 3 is described below.

An unvulcanized silicone rubber is mixed with a filler of 20 parts by weight of AEROSIL 200, produced by Nippon Aerosil Co., which is commercially available fine powder of silica, per 100 parts by weight of the unvulcanized rubber, the resultant mixture was thoroughly kneaded together with a vulcanizing agent and formed into an unvulcanized rubber sheet, which unvulcanized rubber sheet was then left to stand at normal temperature for 3 days.

Then, a stainless steel core metal with an outer diameter of 50 mm was subjected to blasting, thereafter coated with an adhesive, left to stand under an environment of 25° C. for 5 hours, followed by baking at 120° C. for 20 minutes. The above core metal was coated with the unvulcanized rubber sheet as prepared above and subjected to primary vulcanization (by means of a press vulcanizer) under a pressure of 150 kg/cm$^2$ at a temperature of 170° C. for 30 minutes, further to secondary vulcanization at 200° C. for 4 hours, followed by grinding to an outer diameter of 59.5 mm. Subsequently, the above roller was immersed in dimethyl silicone oil (having a viscosity of 100 cp at 25° C.) at 180° C. for 48 hours to be swelled therewith, followed by finishing polishing to an outer diameter of 60 mm, to provide a pressure roller.

The above roller is positioned to the negative order as compared with copy paper in the triboelectric charging level.

In this Example 3 was employed the above pressure roller, which was coated on its surface with a silane coupling agent containing amino group (structural formula: $H_2NCH_2CH_2CH_2Si(OCH_3)_3$) and further left to dry in an oven at 140° C. for 30 minutes. The roller subjected to silane coupling treatment on its surface layer with a silane coupling agent having amino group will become positioned toward more positive order as compared with copy paper in the triboelectric charging level. Preferable silane coupling agents for changing the position of the roller from negative order to positive order relative to copy paper in the triboelectric charging level are as described above.

Next, the fixing apparatus according to this Example having applied the above roller is described by referring to a specific example.

The fixing device of the present invention to be used in an image forming apparatus, in which on a P-type photosensitive member such as of Se is formed a positive latent image and the positive latent image is then developed which a negative toner to be visualized, is illustrated by referring to FIG. 2 as described above (but none of members 6 and 7 are provided).

In FIG. 2, as the fixing roller 1, there was employed a roller having a PFA coating layer of 30$\mu$ in thickness applied as the heat-resistant releasable resin layer 1-1 on a hollow roller core of an aluminum core metal of 60 mm in diameter and 7 mm in thickness and, as the pressure roller 2, a roller of 60 mm in outer diameter consisting of a metal roller core of a stainless steel hollow metal core having on its outer surface an insulating elastomer layer 2-2 of a thermovulcanizable type silicone rubber of 5 mm in thickness applied with the above-mentioned silane coupling treatment applicable for the present invention, which rollers were pressured contacted with each other under the total pressure of 60 kg, and copying was performed at a speed of 23 sheets of A3 size paper/min. (roller circumferential speed of 270 mm/sec).

After continuous passage of 99 sheets of paper, the surface potential on the pressure roller was found to be +3200 to +3800 V, the potential on the copy paper +260 V and the surface potential on the fixing roller −50 to −70 V.

And, the toner offset onto the fixing roller was very small in amount to give a very good result.

EXAMPLE 4

The fixing device of the present invention to be used in an image forming apparatus, in which on N-type photosensitive member of various kinds of OPC (Organic Photoconductor) are formed negative latent images and the negative latent images are then developed with a positive toner to be visualized, is illustrated by referring to FIG. 3 as described above (but none of the members 6 and 7 are provided).

In FIG. 3, as a fixing roller 8, there was employed a roller consisting of a hollow roller core of a stainless steel core metal 8-2 of 24 mm in diameter and 0.5 mm in thickness applied with a heat-resistant releasable resin layer 8-1 of a PFA coating layer of 30μ in thickness and, as a pressure roller 9, a roller of 24 mm in outer diameter consisting of an aluminum core metal of 14 mm in diameter and 4 mm in thickness covered with a silicone rubber sponge 9-1 with a sponge hardness (ASKER C) of 25, of which outer circumferential surface is further coated with a thermovulcanizable silicone rubber coating 9-2 of 1 mm in thickness applied with the same silancoupling treatment (AEROSIL 200 treated with $(C_2H_5)_2N—C_3H_6Si(OCH_3)_3$), which rollers were pressured contacted with each other under the total pressure of 5 kg, and copying was performed at a speed of roller circumferential speed of 60 mm/sec on A4 size paper.

The surface potential on the pressure roller after passage of one sheet was found to be +650 V, the potential on copy paper −300 V and the surface potential on the fixing roller −30 to 31 40 V. And, the toner offset onto the fixing roller was very small in amount to give a very good result.

COMPARATIVE EXAMPLE 3

The same paper passage test was conducted by use of entirely the same fixing device as in Example 3, except for using, as the pressure roller 2, the roller before the treatment with the silane coupling agent as described above, namely a thermovulcanizable type silicone rubber comprising 20 parts by weight of fine powder of silica conventionally used (fine powder of silica obtained by subjecting Aerosil 200 to hydrophobic treatment with hexamethyl disilazane) added to 100 parts of the rubber.

The surface potential on the pressure roller after passage of 99 sheets of paper was −6000 V or more (greater in absolute value, toward negative), the potential on copying paper +300 V and the surface potential on the fixing roller −50 to −70 V. And, toner offset too much in amount to be cleaned at the cleaning web 6-1 was generated to result in lowering in copy quality.

COMPARATIVE EXAMPLE 4

The same paper passage test was conducted by use of entirely the same fixing device as in Example 4, except for using, as the pressure roller, the roller before the treatment with the silane coupling agent containing amino group as described above, namely a silicone rubber of the type vulcanizable at room temperature comprising 20 parts by weight of fine powder of silica conventionally used (fine powder of silica obtained by subjecting Aerosil 200 to hydrophobic treatment with hexamethyl disilazane) added to 100 parts of the rubber.

The surface potential on the pressure roller after passage of 1 sheet of paper was −800 V, the potential on copying paper +70 V and the surface potential on the fixing roller −30 to −40 V.

And, toner offset was very much in amount.

Table 1 shows the amounts of offset toners in Example 3, Comparative Example 1 Example 4 and Comparative Example 2, respectively. The offset toner amount was shown in terms of the weight percentage (%) relative to the total toner amount on the copy paper.

TABLE 1

| | Example 3 | Comparative Example 1 | Example 4 | Comparative Example 2 |
|---|---|---|---|---|
| Amount of offset toner (%) | 0.04 | 0.6 | 0.06 | 0.13 |

From Table 1, it can be seen that the toner offset in Example 3 could be reduced to 1/15 of the amount of the prior art example (Comparative Example 1).

On the other hand, in Example 4, the toner offset could be reduced to 6/13 of the toner offset amount of the prior art example (Comparative Example 2). The reason for this effect is described below.

As described above, the toner offset onto the fixing roller occurs when the resultant force of $\vec{F}$ is directed towards the fixing roller side and therefore, for prevention of toner offset, the resultant force of $\vec{F}$ may be directed toward the pressure (or pressurizing) roller side. In this Example, by addition of a filler to the pressure roller, the pressure roller and the copy paper were changed in order in the triboelectric charging level, primarily from $\vec{F5}$ to $\vec{F6}$. According to this Example 4, through the triboelectric and peel-off charging between the copy paper and the pressure roller, negative charges are imparted to the copy paper, while positive charges to the pressure roller. And, the distance to the toner image is nearer from the copy paper than from the pressure roller, and therefore the force $\vec{F5}$ was found to be prevailing as confirmed by the experiment, when the absolute values of the charged potentials on the copy paper and the pressure roller were comparable or when that of the pressure lower was lower by several times. More specifically, when the potentials of the copy paper and the pressure roller satisfy the above conditions, the polarity of the pressure toner may be made the same as that of the toner polarity, and the back face of the paper may be charged to a polarity opposite to that of the toner, as in Example 4 according to this invention. This is particularly suitable when applied for an image forming apparatus employing a positive toner. The fixer satisfying the above conditions may be considered to be found in, for example, a so-called low speed image forming apparatus, in which the fixing speed is slow and the total pressure is low, or even with a high speed, in the case where the elastomer layer of the pressure roller has a very thin thickness and the triboelectric charging potential is very low in spite of increase of triboelectric charges.

Next, when the charging potential on the pressurizing roller becomes about 10-fold as compared with that on the copy paper, the toner offset onto the fixing roller was confirmed by the experiment to be controlled conversely by $\vec{F6}$. In the case, when the $\vec{F6}$ becomes prevalent, namely the case when the absolute value of the potential on the pressure roller is overwhelmingly greater than that of the copy paper, the pressure roller may be coated on its surface with an electrification agent so that it may be triboelectrically charged to a polarity opposite to the polarity of the toner image, as in Example 3. This is particularly suitable when applied for an image forming apparatus employing a negative toner. The fixer satisfying this conditions may be considered to be one in, for example, a so-called high speed image forming apparatus in which fixing speed is rapid and the total pressure is high, or in the case when the pressure roller has a relatively large thickness with a small capacitance and therefore is liable to be charged to high potential.

The effect of the present invention is markedly more excellent in the case when the polarity per se of the rotatable member for fixing is reversed by application of a specifically related electrification agent according to the present invention than in the case when the polarity of the rotatable member for fixing can be so stabilized to be several times or more that an electrical field capable of preventing offset of a material to be fixed onto a rotatable member for fixing may be formed. For example, in the prior art device having a recording material bearing a material to be fixed on one surface, the rubber roller as a rotatable member for pressurization which is not directly contacted with the material to be fixed will generally be triboelectrically charged negatively. In this case, by applying the present invention, namely by applying surface treatment or coating with an electrification agent capable of changing the characteristics of a rotatable member (such an electrification agent is called as polarity-changing electrification agent), for example, a polarity-changing electrification agent such as a silane coupling agent, on the rubber roller, an excellent effect of the present invention can be obtained.

In the incorporation type as in the Example shown in FIG. 3, the electrification agent may have a mean primary particle diameter desirably within the range from 0.001 to 2$\mu$ in view of dispersibility and charged state, particularly preferably fine powder within the range from 0.002 to 0.2$\mu$ may be used.

The silica of the dry system method as mentioned above is obtained by, for example, a method utilizing pyrolytic oxidative reaction of silicon tetrachloride gas in oxygen-hydrogen flame, and the basic reaction scheme is represented as follows:

$$SiCl_4+2H_2+O_2 \rightarrow SiO_2+4HCl$$

Also, in this manufacturing step, it is possible to obtain a complex fine powder of silica with other metal oxides, but using halides of other metals such as aluminum chloride or titanium chloride together with the silicon halide compound, and these embodiments are also included.

On the other hand, the wet system method is a method in which, for example, sodium silicate in neutralized with an acid, and the basic reaction scheme may be represented as follows:

$$Na_2O_mSiO_2+HCl+H_2O \rightarrow SiO_{2n}H_2O+NaCl$$

As the acid, there may also be employed, other than hydrochloric acid, sulfuric acid, nitric acid, phosphoric acid, carbon dioxide, sulfur dioxide and others.

In the above Examples, by using a pressure roller positioned to more positive order relative to the paper as a recording material in the triboelectric charging level and applying such a pressure roller to a fixing device in an image forming apparatus having a negative image, toner offset caused by electrostatic force could be extremely reduced with a simple construction.

(2) The Examples set forth below correspond to further excellent part of the present invention, having specific features in applying particularly a charge controllable parting agent selected from among electrification agents, which has also a parting characteristic, or in a coating member for application thereof or others.

This invention can improve the appearance of a material to be fixed particularly by preventing scattering of the material to be fixed and it can also prevent offset phenomenon.

In the following, examples of charge controllable parting agents are enumerated, and Examples by use thereof are to be described by referring to the drawings. The charge controllable parting agent mentioned in the following description, when it is to be coated, is inclusive of an electrification agent dispersed or mixed in or chemically bound to a parting liquid (typical example is silicone oil) and also those as set forth below, further including all of those similar in technical thought to the present invention. When impregnated or immersed into the surface layer of a rotatable member, it is suitable to use an electrification agent which is itself endowed with parting characteristic and electrification characteristic, namely having both of the above characteristics as a single species, such as an amino-modified silicone oil.

Group 1 Of Exemplary Charge Controllable Parting Agent:

The charge controllable parting agents shown below are those to be positioned to more positive orders than recording materials in triboelectric charging level. As the charge controllable agent, it is possible to use:

(1) A dimethyl silicone oil of which methyl moiety is partially substituted with amino group (hereinafter called as amino-modified silicone oil).

Examples of the skeltal structure of the amino-modified silicone oils are shown below.

Type A (i)

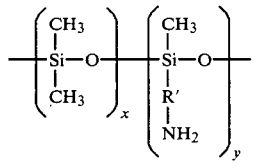

Type B (ii)

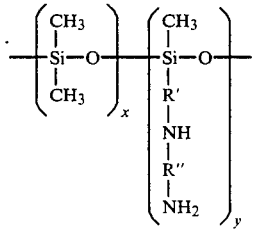

Examples of Type A may include those of trade names KF 864, X-22-3801 (both produced by Shinetsu Kagaku Kogyo Co.) and trade name SF 8417 (produced ty Toray Silicone Co.). On the other hand, examples of Type B may include those of trade names KF 393, KF 857 and KF 859 (all produced by Shinetsu Kagaku Kogyo Co.). Also, as the material to be subjected to amino modification other than dimethyl silicone oil, a parting agent such as methyl phenyl silicone may suitably be used in this Example.

Alternatively, as the silicone oil having amino group, it is also possible to use an amide-modified silicone (e.g. KF 3935, trade name, produced by Shinetsu Kagaku Kogyo Co.) or silicone diamine (e.g. X-22-161, trade name, produced by Shinetsu Kagaku Kogyo Co.).

(2) In addition to the above examples, there may be also included the charge controllable parting agents obtained by treatment of silicone oil with the silane coupling agents containing amino group as shown below:

$H_2NCH_2CH_2CH_2Si(OCH_3)_3$ $H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_5C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NH.$ $CH_2CH_2CH_2Si(OCH_3)_3$ $H_3COCOCH_2CH_2NHCH_2CH_2NHCH_2CH_2CH_2Si(OCH_3)_3$

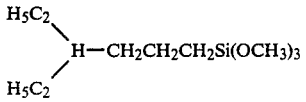

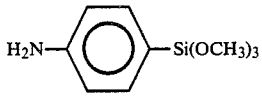

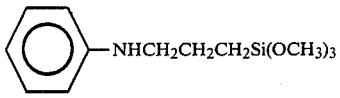

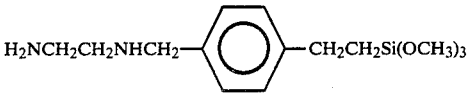

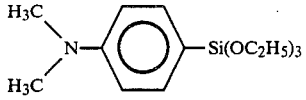

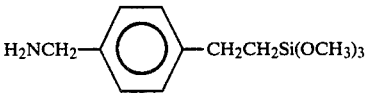

-continued

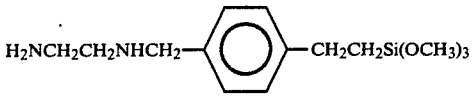

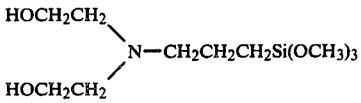

$(H_3CO)_3SiCH_2CH_2CH_2-NHCH_2$
$(H_3CO)_3SiCH_2CH_2CH_2-NHCH_2$

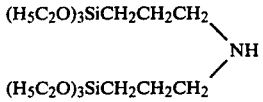

$H_3NHCH_2CH_2CH_2Si(OC_2H_5)_3$ $H_2N(CH_2CH_2NH)_2CH_2CH_2CH_2Si(OCH_3)_3$ $H_3C-NHCONHC_3H_6Si(OCH_3)_3$

In the above compounds, the alkoxy group may be replaced by chlorine atom. There silane coupling agents may be employed as a single kind or a mixture of two or more kinds.

(3) The charge controllable parting agent as mentioned above may be used as a single species for coating, impregnation or immersion, but a mixture comprising the above charge controllable parting agent added to a conventionally used parting agent such as dimethyl silicone oil, methyl phenyl silicone oil and fluorosilicone oil is also applicable for coating. In this case, in addition to the advantage that the characteristics such as thermal stability or viscosity can freely be chosen, cost reduction is also possible by decreasing relatively the amount of the amino-modified oil employed which is comparatively more expensive. For example, a sample prepared by adding $10^{-3}$ wt.% of a dimethyl silicone oil KF 96H having a viscosity of 10,000 cs at 25° C. to SF 8517 (produced by Shinetsu Kagaku Kogyo Co.) to SF 8417 (amino equivalent 3500/amino (%) 0.5, produced by Toray Silicon Co.) was confirmed to be applicable as the charge controllable parting agent for coating according to the present invention. Of course, the lower limit of the amount added is not limited by the above-mentioned value, but even less amount of a charge controllable agent may be applicable by use of a suitable combination of materials.

(4) Further, a mixture having the charge controlling agent having a structural formula as shown below added to a parting agent such as dimethyl silicone oil is also suitable for coating.

NCL-3 (OLOA 313)

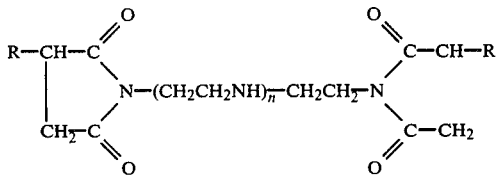

R is polybutene

-continued

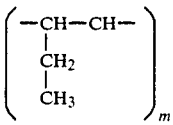

OLOA 5080

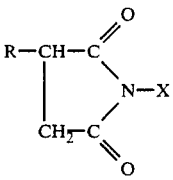

R is polybutene

Nylon 12

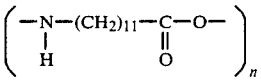

Duomine (Lion-Armor Co.)

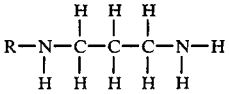

R is an alkyl group

Armanc C

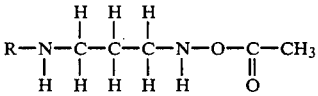

R is an alkyl group

I. Fatty acid monoethanolamide:

$R-CO-NH-CH_2CH_2OH$

For example R may be $C_{11}$-$C_{17}$ hydrocarbon residue of fatty acids, e.g. lauryl group.

II. Fatty acid diethanolamide:

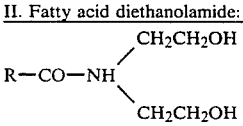

For example, R may be $C_{11}$-$C_{17}$ hydrocarbon residue of fatty acids, e.g. lauryl group.

The charge controlling agent as described above may be added in a minute amount to the parting agent to have sufficient offset preventive effect. For example, sufficient effect can be obtained even by addition at a level of about $10^{-3}$ parts by weight per 100 parts by weight of silicone oil.

Group 2 Of Charge Controllable Parting Agents:

The following charge controllable parting agents are those positioned to more negative order than recording material in triboelectric charging level.

(1) It is suitable to use a silicone oil having a halogen atom such as halo-modified silicone oil, particularly a silicone oil having chlorine atom. Also in this example, in addition to silicone oil, dimethyl silicone oil, fluorosilicone oil or methyl phenyl silicone oil may be available as the material to be modified. In this case, the agent is suitable for impregnation or immersion into the surface layer of roller or coating onto the surface.

(2) Otherwise, a mixture having added a fluorine type surfactant added to silicone oil is suitable for coating.

(3) Further, fluorosilicone oil is suitable as negative electrification agent, and a mixture having added this into silicone oil may also be used for coating.

The following Examples employing the charge controllable parting agents as described above are described below.

Figure 4:
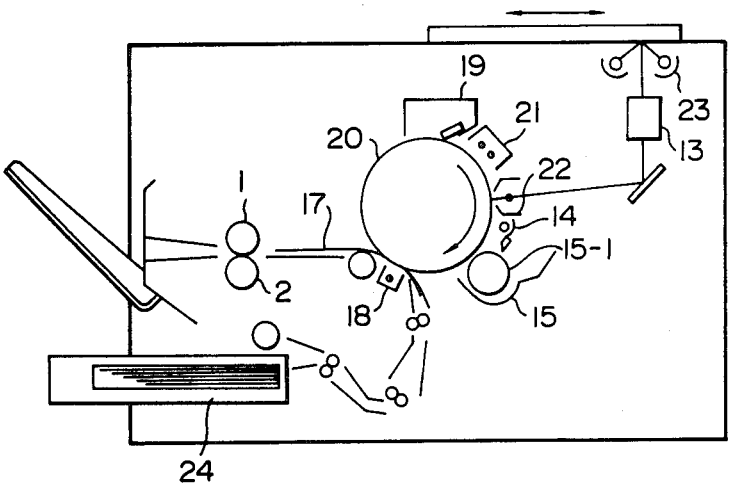
FIG. 4 shows a schematic drawing for illustration of an electrophotographic apparatus for which the present invention is applied.

First, an embodiment of an electrophotographic apparatus as shown in FIG. 4, for which the present invention is applied, is described, followed by the descriptions of the respective Examples 5 to 8.

The photosensitive material for formation of electrostatic latent images and the formation process as shown in FIG. 4 is based on the disclosure in Japanese Patent Publication No. 23910/1967, but the present invention is not limited to these but any of other known materials or processes may be applicable, such as those disclosed in Japanese Patent Publications Nos. 2040/1969, 19748/1967, 24748/1968, 37957/1970, 27048/1974, 13437/1969, 24077/1970, 17947/1968, 25236/1970 and others. Now, description is made about the device shown in the drawing.

A photosensitive drum 20 having a photosensitive layer provided on a metal cylinder is uniformly positively charged by a primary charger 21, subsequently charged again by a secondary charger 22 giving the polarity opposite to that of the primary charger 21, and at the same time exposed to a light image of an original by a lamp 23 and through an optical system 13. By doing so, electrostatic latent image is formed as the difference in the surface potential density corresponding to the light and dark pattern of the optical image on the surface insulating layer on the photosensitive drum 20, and then, the entire surface of the photosensitive layer is uniformly exposed by a whose surface exposure lamp 14, thereby creating a difference in surface potential corresponding to the light and dark portions in the original image to form a highly contrasted electrostatic latent image, followed by development and visualization of the above latent image with a toner negatively charged through triboelectric charging with a developing sleeve 15-1 in a developing vessel 15. The above developing process employed is based on the method or the device as disclosed in Japanese Laid-open Patent Publications Nos. 18656/1980, 18657/1980, 18768/1980 and 18679/1980.

As the next step, the back face of a supporting material 17 such as paper supplied from a cassette 24 is given positive charges from a transfer charger 18, and, by the electrostatic attracting force of the charges, the visualized image on the above photosensitive drum is transferred to the supporting material, followed by heat fixing of the transferred toner image by means of the rollers 1 and 2.

The drum 20 is cleaned by a blade cleaning means 19 for reuse.

EXAMPLE 5

Figure 5:
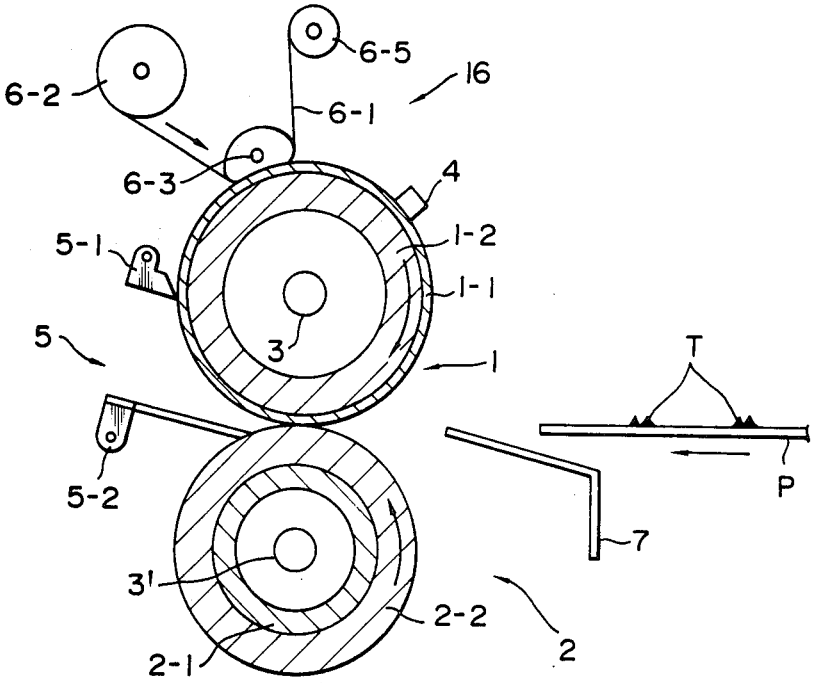
FIG. 5 through FIG. 10 each show a sectional view for illustration of an embodiment of the present invention.

In the embodiment shown in FIG. 5, the pressure roller 2 is pressure contacted against the fixing roller 1 by a known pressurizing means at least during fixing, and it has an elastomer layer such as of silicone rubber, fluorine rubber, fluorosilicone rubber, etc. with a relatively thick thickness provided on the outer circumferential surface of a roller core of a metal. Both rollers 1 and 2 will be rotated through pressure contact at least once by receiving the rotational signal such as copy signal before passing of paper.

According to this Example, by coating of a positive charge controllable parting agent from the fixing roller 1 side similarly as in a conventional means for coating of a parting agent, with a simpler construction, the parting agent is transferred from the fixing roller 1 through the circumferential surface of the fixing roller 1 to the pressure roller 2 with a more thick insulating layer. By this operation, the polarity of triboelectric charging of the pressure roller, which is relatively smaller in capacitance as compared with the fixing roller 1 and readily chargeable to a high potential, relative to copy paper is reversed to charge the pressure roller 2 to a high positive potential. Accordingly, electrostatic offset to the fixing roller 1 can be extremely reduced to give a copy of high image quality without disturbance of the image such as scattering.

To describe in more detail, the charge controllable parting agent is applied from the side of the rotatable member 1 at which the applying member 16 is contacted with the toner image T, and positive charges are generated on the rotatable member 2 on the side not contacted with the toner image. This applying member 16 is a member for coating of a charge controllable parting agent which also functions as a cleaning member for removing foreign matters such as offset toner adhered on the fixing roller surface, paper powder, etc. from the roller surface. Further, the applying member consists of a web 6-1 comprising a heat-resistant unwoven fabric such as Nomex, Teflon, etc. which is impregnated with a charge controllable parting agent as described above (e.g. amino-modified silicone oil).

As to the constitution of the applying member 16, it is contacted against the heating roller by a press roller 6-3 having elasticity such as of silicone rubber, fluorine rubber, fluorosilicon rubber, silicone rubber sponge, etc. The web 6-1 is displaced in its contacted positions little by little from the feeding roller 6-2 by the wind-up roller 6-5 by which it is driven, so that the cleaning web 6-1 is constantly contacted at its fresh face against the fixing roller 1.

By the way, as described above, the present inventors have confirmed that offset of toner by electrostatic force depends greatly on the surface potential on rollers, recording material and others. In general, the surface potential on a roller, when it is deemed to be a concentric cylinder, can be represented as follows:

$$V=\{\log (R/r)/2\pi\epsilon_0\epsilon_r l\}\cdot Q \quad (1)$$

wherein R: outer diameter of roller (m), r: inner diameter of insulating surface coating layer (m), $\epsilon_0=8.854\times10^{-12}$ F/m, $\epsilon_r$: specific dielectric constant, l: length of insulating coating.

From the above formula (1), it can be seen that the roller can be charged to higher potential as the thickness (R−r) is greater or the specific dielectric constant is smaller.

In the construction according to this Example, because the insulating coating layer 1-1 of the fixing roller 1 is relatively thin and the insulating layer 2-2 of the pressure roller 2 is relatively thick, the polarity of triboelectric charging on the pressure roller and its potential can be controlled by the charge controllable parting agent, so that it is rendered possible to reduce extremely the offset onto the fixing roller. Also, as an accompanying effect, image disturbance such as scattering which occurs primarily during fixing can be prevented. Thus, it has been made possible to obtain a copy of high quality.

The effect of this Example will be shown below by referring to detailed numerical values. In FIG. 5, as the fixing roller 1, a roller of 60 mm in outer diameter having a PFA coating of 30 μm in thickness applied on an aluminum core metal with a thickness of 7 mm was employed, and, as the pressure roller 2, a roller having a thermovulcanizable silicone rubber coating with a thickness of 5 mm applied on a hollow stainless steel core metal. Both rollers were pressure contacted under a total pressure of 60 kg, and fixing treatment was conducted on plain paper (A3 size) at a speed of 23 sheets/min. (roller circumferential speed of 270 mm/sec).

As the charge controllable parting agent to be impregnated into the web 6-1, a controllable parting agent comprising a mixture of 100 parts by weight of a dimethyl silicone oil (KF-96H, produced by Shinetsu Kagaku Co.) having a viscosity of 10,000 at 25° C. and 0.1 part by weight of an amino-modified silicone oil having a viscosity of 70 cs at 25° C. and an amine equivalent of 830 (KF 857, produced by Shinetsu Kagaku Co.) was employed and the web was impregnated with 90 g of this agent per 15 ml of web. The delivery speed of the web was controlled to 0.5 mm/min.

When a transferred image having 300 mg of toner image per one sheet on A3 plain paper (the condition under which offset is most readily formed) was fixed under the above conditions, the toner offset percentage was 0.03% or less, without causing any problem at all.

The surface potential on the pressure roller after passage of 99 sheets was found to be +6000 V or higher, the surface potentail on the fixing roller −100 V and the surface potential on the paper +180 V.

The results as set forth above indicate that the offset may be reduced on account of the following factors. That is, in transferring a positive latent image after development with a negative toner to plain paper, plus charges are given to plain paper and transfer occurs through the electrostatic attracting force between the plus charges and negative toner. Thus, at this point of time, plain paper is charged to plus. In the subsequent fixing step, when the plain paper P undergoes triboelectric peel-off charging with the pressure roller 2 during passage through the nip portion, the charge controllable parting agent, namely amino-modified silicone oil mixed with silicone oil acts on the pressure roller to make it charged highly to plus. Therefore, the plain paper will be negatively charged, as opposite to the positive charges which should hold the negatively charged toner.

Thus, the phenomenon alone which imposes charges of the same polarity as the toner image on the back face of paper would seen to be favorable for offset prevention, but it should be noted that another phenomenon by far significant than this phenomenon is occurring. That is, the pressure roller with smaller capacitance as compared with paper will be charged to a potential which is very great as compared with paper and have a great electrostatic attracting force on the negative toner on the plain paper to such an extent as to render the charges on the back face of paper negligible. For these reasons, during fixing, negative toner can be strongly held on the paper face, whereby offset can be prevented.

Simultaneously with the above action, no scattering or disturbance occurs at all to give copies of high quality. Moreover, while the reason why the fixing roller is negatively charged is not clear, the amino-modified oil of the charge controllable parting agents coated on the fixing roller seems to be selectively migrated to the pressure roller. Then, when copying was further continued under the above conditions, the copy obtained even after passage of 100,000 sheets of paper was of high quality, not substantially changed as that at the initial stage with very small amount of offset. Besides, although the single substance of the amino-modified oil has a heat-resistant temperature of about 140° C., because it is used in this Example as a mixture with silicone oil, silicone oil covers over the amino-modified oil to have a heatproof effect, resulting in no decomposition of amino group at all even when used at around 200° C., and the effect can be persistent for a long term. Also, by applying a mixed charge controllable parting agent having $10^{-3}$ part by weight of an amino-modified silicone oil mixed with 100 parts by weight of dimethyl silicone oil on the roller, the pressure roller potential became effectively +6000 V or higher.

COMPARATIVE EXAMPLE 3

Next, as Comparative Example 3, according to a procedure conventionally practiced in the prior art, by use of a web impregnated with 90 g of dimethyl silicone oil (KF 96H, produced by Shinetsu Kagaku) having a viscosity of 10,000 at 25° C. per 15 ml of web for the web 6-1, paper passage fixing was conducted similarly as in Example 5. As the result, the toner offset percentage was 0.6%, indicating that 20-fold of toner as compared with Example 4 was offset onto the fixing roller. There also occurred scattering of image, which was still increased as the progress of continuous passage of papers. This is caused by increase in the surface potential of the pressurizing roller as the progress of continuous passage of papers. The surface potential on the pressure roller after passage of 99 sheets was found to be −6000 V or higher (about −4000 V after passage of one sheet), the surface potentail on the fixing roller −200 V and the surface potential on paper +210 V.

The reason for the above results is that the surface of the pressure roller was charged to a very great minus potential as compared with that of paper by triboelectric peel-off charging with paper, which potential had a great electrostatic expelling force against the negative toner on plain paper to such an extent as to make the charges on the back face of paper negligible, whereby the negative toner was transferred onto the fixing roller to cause offset and image disturbance such as scattering.

EXAMPLE 6

Figure 6:
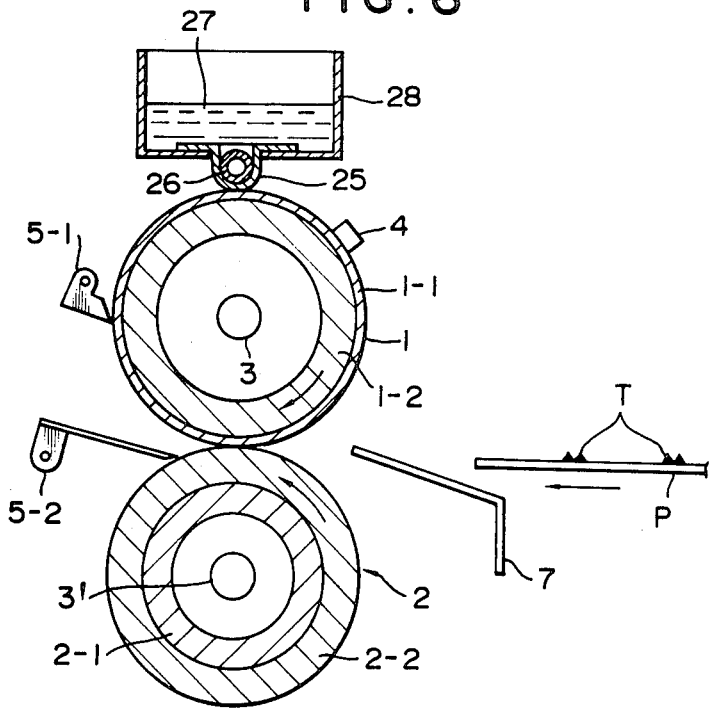

FIG. 6 shows another embodiment (similar to FIG. 5). The same numerals have the same meanings as in FIG. 5, and explanation thereof is omitted.

In FIG. 6, as the coating member for the charge controllable parting agent, a porous membrane 25 and a porous tube 26 of tetrafluoroethylene are used. The porous membrane 25 employed had pore sizes of 0.5 to 0.55μ and a void volume of 85%, and the porous tube 26 employed had pore sizes of 1.0 to 1.1μ and a void volume of 85%. The porous membrane 25 is fused partially to the vessel 28. The vessel 28 contains a charge controllable parting agent therein.

As the charge controllable parting agent 27, an amino-modified silicone oil having a viscosity at 25° C. of 3,500 cs and amine equivalent of 2,000 was employed and paper passage was performed similarly as in Example 5. As the result, the toner offset percentage was 0.03% even after copying of 100,000 sheets, and there was no image disturbance such as scattering caused electrostatic force at all to obtain copies of high quality.

In the case as described above, paper was passed at a roller surface temperature of 180° C., but the temperature of the charge controllable parting agent in the vessel 28 was about 100° C. and substantially no decomposition of amino group was observed to give good results over a long term.

To summarize the above Examples 5 and 6, these Examples are characterized by having means for coating of charge controllable parting agent on a first rotatable member on the side to be contacted with a material to be fixed and applying the charge controllable parting agent through the first rotatable member on a second rotatable member pressure contacted with the first rotatable member and provided for the purpose of grip and transport of a recording material. Further, the charge controllable parting agent is charged to the polarity opposite to the polarity of a material to be fixed, and has the function of converting the second rotatable member to the opposite polarity or charge holding at the opposite polarity.

The "charge holding" mentioned here means that even the second rotatable member improved to have a high offset effect with an electrification agent as described above can be made by coating of a charge controllable parting agent to have further improved and presistent offset effect.

In the above Examples, as the charge controllable parting agents, those having positive charging characteristics are shown, but when a material to be fixed such as toner is positively charged, those having negative charging characteristics can also be used to obtain the effect as described above.

Each of the above Examples is effective particularly for the case when a first rotatable member is relatively inactive or/and small in friction coefficient and a second rotatable member is relatively active or/and large in friction coefficient.

EXAMPLES 7 AND 8

Figure 8:
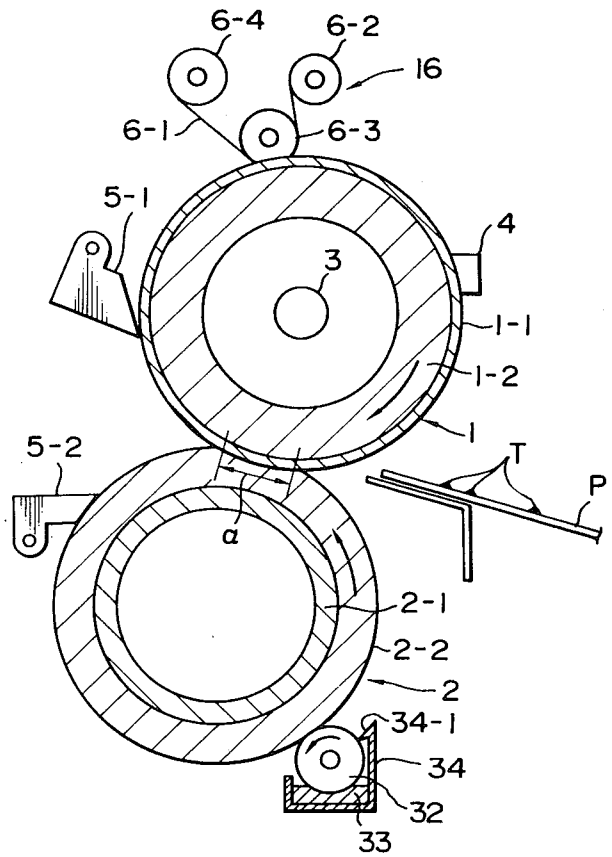
Figure 7:
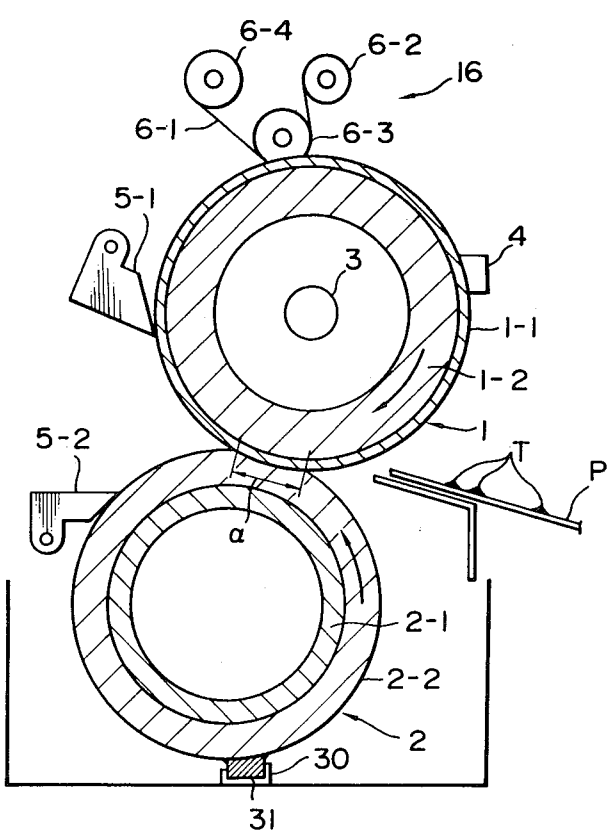

The following Examples are based on FIG. 7 and FIG. 8 and their specific features reside in a fixing device for fixing a material to be fixed onto a recording material, comprising a first rotatable member having a coating layer with parting characteristic contacted with a material to be fixed and a second rotatable member having an elastomer layer which rotates through pressure contact with the first rotatable member, characterized in that the second rotatable member is applied on its surface directly with a charge controllable parting agent for charging the surface to the polarity opposite to that of the material to be fixed.

According to these Examples 7 and 8, a charge controllable parting agents is applied directly on the second rotatable member, and therefore the second rotatable member can be instantly charged to a desired polarity and its surface potential enables prevention of scattering of a material to be fixed and prevention of transfer of the material to be fixed from the second rotatable member to the back face of recording material.

The fixing device as shown in FIG. 7 and FIG. 8 is to be applied for an electrophotographic apparatus as shown in FIG. 4. First, the common constitution in these respective drawings is explained.

FIG. 4 shows an embodiment wherein the negative toner image T formed according to electrophotographic process by means of a heating fixing device is fixed on the plain paper P to a thickness of some 10μ (usually about 70μ to 100μ).

FIG. 7 and FIG. 8 have a basic constitution wherein the fixing roller 1 and the pressure roller 2 as explained with reference to FIG. 2 are employed and the web 6-1 of the cleaning member 16 impregnated with a parting agent (e.g. silicone oil) as explained with reference to FIG. 5 is contacted against the fixing roller 1.

And, the pressure roller 2 has an insulating elastomer layer with a relatively thick thickness of 1 mm or more and constitutes a pressure contact region α together with the fixing roller.

In the fixing device having the above construction, the fixing roller 1 to be contacted with toner image has on its surface a resin layer which is inactive and small in friction coefficient, while conversely the pressure roller 2 is active with large friction coefficient and has a relatively thick elastomer layer. Accordingly, as can be seen from the formula (1) as described above, the surface potential of the pressure roller 2 is the primary cause of offset generation.

In the embodiments shown in FIG. 7 and FIG. 8, charge controllable parting agent is applied directly and continuously upon the pressure roller 2.

These can maintain the effect of the Examples as described above semi-permanently for longer period of time.

As shown in FIG. 7, in a fixing device having a constitution similar to those in the foregoing Examples, there is provided a heat-resistant unwoven fabric 31 of 10 mm in width and 2 mm in thickness supported on a supporting member 30 which is in contact with the pressure roller 2 over its entire length. The heat-resistant unwoven fabric 31 is impregnated with 10 cc of a charge controllable parting agent obtained by adding an amino-modified silicone oil KF 857 in a weight ratio of 0.01 wt.% to a dimethyl silicone oil KF 96H. When toner image was fixed on plain paper under the same conditions as in the preceding Examples with the use of the constitution of this Example, the effect was persistent, with the offset percentage being 0.03% or less and the potential on the pressure roller being +6000 V or higher even after 50,000 sheets of copying according to the intermittent copying of one sheet per one minute.

The above amino-modified silicone oil may be applied through an applying roller or applied on the rotatable member per predetermined number of rotations by utilization of an eccentric cam for contact. Alternatively, as shown in FIG. 2, it can also be applied by utilization of thermal expansion of the pressure roller.

In FIG. 8, there is shown an embodiment wherein a positively chargeable charge controllable parting agent 33 is contained in a vessel 34 having a coating amount regulating blade 34-1, and the parting agent is supplied by means of the coating roller 32 from the vessel 34. The coating roller 32 is rotating in the same direction as the pressure roller 2 and has a length capable of applying the charge controllable parting agent over whole of the pressure roller 2.

Rotation of the coating roller 32 may be regulated either continuously or intermittently.

If the coating member of this Example is made of a material which is negatively chargeable as opposed to the charge controllable parting agent (positively chargeable) as containing a component of the plain paper P, the surface of the pressure roller can be uniformly triboelectrically charged positively before fixing on the toner image onto the plain paper P. This technical thought can be applied effectively for each of positive and negative toners so as to be adapted for the basic principle of the present invention. This can afford supplement of the shortage in triboelectric charging at stand-up. Of course, the above explanation may be applicable also for other coating members.

Alternatively, as in the constitution shown in FIG. 2, the distance d may be made null by elevation of the temperature set during copying so that the coating member may be contacted against the pressure roller surface. In other words, by putting the relation of the setting temperature T during copying to the setting temperature To at stand-by into T>To, constitution is made so that the pressure roller may be contacted against the coating member through expansion of the pressure roller surface by the heat corresponding to the temperature difference between T and To.

Accordingly, when copy switch is turned on, the fixing roller 1 begins to rotate simultaneously with pressure contact rotation of the pressure roller 2. Through pressure contact rotation, the insulating elastomer layer of the pressure roller gains heat from the fixing roller to be expanded, until it is contacted against the heat-resistant parting agent impregnated with the charge controllable parting agent, whereby the charge controllable parting agent is applied on the pressure roller surface. After completion of copying, the roller releases heat spontaneously to be shrinked again and becomes apart from the heat-resistant unwoven fabric. This enables good prevention of thermal deterioration of the charge controllable parting agent.

In this case, by use of a mixture having 0.1 wt.% of an amino-modified silicone oil KF 393 added to dimethyl silicone oil KF 96 as the charge controllable parting agent and by use of a pressure roller of 60 mm in outer diameter having an elastomer layer of 5 mm in thickness, fixing treatment was conducted on a plain paper with A3 size according to Japanese Industrial Standard at a roller circumferential speed of 270 mm/sec. As the toner, a toner charged to minus (negative tone) was employed and 300 mg of toner per one sheet of A3 plain paper was fixed. As the result, by intermittent copying of 20 sheets per 10 minutes, good offset prevention effect with an offset percentage of 0.03% even after fixing of 70,000 sheets as the total was confirmed, and no image disturbance was observed.

As apparently seen from the above explanation, by applying a positive charge controllable parting agent (more preferably having a high electron-donating characteristic) on a rotatable member to be contacted with the recording material face on the side opposite to the side at which a negative material to be fixed under unfixed state is fixed, more excellent offset prevention can be accomplished more securely than the prior art, and also image disturbance such as scattering can be excellently prevented. On the contrary, when the material to be fixed under unfixed state has positive charges, a negatively chargeable charge controllable parting agent may be employed.

Further, durability can be improved better when the above coating member is made to leave from the pressure roller or the heating source during non-fixing period according to known means.

Now, by use of the fixing roller 1 and the pressure roller 2 as constituted above, the above-mentioned amino-modified silicone oil was applied uniformly only once on the surface of the pressure roller 2, and the durability obtained thereby was confirmed. The effect obtained was at the initial stage that the toner offset percentage was 0.03% and the surface potential on the pressure roller was +6000 V or higher. However, in spite of merely one coating before fixing, the effect was persistent even after the fixing treatment was continuously conducted for 3000 sheets. As the method for one coating before fixing, it is suitable to package the roller with a packaging member coated with a charge controllable parting agent on its surface, during packaging of the roller, thereby applying the parting agent on the roller surface. Thus, the pressure roller applied with a charge controllable parting agent can bring about excellent offset preventive effect.

The above Example is effective for a machine of the type in which number of sheets employed is relatively smaller or a machine of the type in which successive copying is rarely performed, because offset preventive effect can be maintained for a long time.

EXAMPLE 9

According to the following Example 9, offset and scattering of image are prevented by a constitution characterized by having a charge controllable parting agent which itself exhibits parting characteristic and charging characteristic incorporated in the rotatable member.

Now, an embodiment similar to FIG. 2, but without members 6 and 7 is supposed.

The fixing roller 1 has in its inner portion a heating source 3 and has a heat-resistant resin layer 1-1 with parting characteristic (uniform thickness layer with its thickness being a predetermined value within the range from 20 to 80μ) such as of tetrafluoroethylene resin PTFE or PFE on the surface. The pressure roller 2 is pressure contacted with the fixing roller 1 but includes internally no heating source, and it has a relatively thick elastomer layer 2-2 (uniform layer thickness within the range of about 1 to 5 mm) such as of silicone rubber, fluorine rubber of fluorosilicone rubber containing a charge controllable parting agent on the circumferential surface of a metal roller core 2-1. Other constitutions are the same as in FIG. 3.

The charge controllable parting agent applicable for this Example 9 may include (1) and (2) among the Groups 1 and 2. Particularly, it is suitable to use one which does not impair greatly the characteristics or pysical properties of the material of the roller surface layer when impregnated or added into the rotatable member.

Alternatively, other than those as mentioned above, for example, a charge controllable parting agent having 1 wt.% of KF 393 (amine equivalent 360, produced by Shinetsu Kagaku Kogyo Co.) added to dimethyl silicone oil having a viscosity at 25° C. of 100 cs (e.g. KF 96) is also suitable. Thus, a charging agent having charge controllability is mixed into a parting agent, it is preferred to incorporate a charge controllable parting agent in greater proportion than in the case of coating as described above. Greater proportion, however, means that the amount added may be sufficiently as small as 100:1 in terms of the weight ratio.

The following description refers to concrete numerical values. The pressure roller applicable for this Example was prepared according to the following method.

An unvulcanized silicone rubber is mixed with 30 parts by weight of a filler for reinforcement such as fine powder of silica, per 100 parts by weight of the unvulcanized rubber, the resultant mixture was thoroughly kneaded together with a vulcanizing agent and formed into an unvulcanized rubber sheet, which unvulcanized rubber sheet was then left to stand at normal temperature for 3 days.

Then, a stainless steel core metal with an outer diameter of 50 mm was subjected to blasting, thereafter coated with an adhesive, left to stand under an environment of 25° C. for 5 hours, followed by baking at 120° C. for 20 minutes. The above core metal was coated with the unvulcanized rubber sheet as prepared above and subjected to primary vulcanization (by means of a press vulcanizer) under a pressure of 150 kg/cm$^2$ at a temperature of 170° C. for 30 minutes, further to secondary vulcanization at 200° C. for 4 hours, followed by grinding to an outer diameter of 59.8 mm.

Subsequently, the above roller was immersed in a charge controllable parting agent comprising a mixture of 1 part by weight of an amino-modified silicone oil (KF 857 produced by Shinetsu Kagaku: structural formula of A type, amine equivalent 830, viscosity at 25° C. of 70 cs) mixed with 100 parts by weight of dimethyl silicone oil (KF 96, produced by Shinetsu Kagaku, having a viscosity at 25° C. of 100 cs) and left to stand for 48 hours, while maintaining the liquid temperature at 70° C., to be swelled therewith, followed by finishing polishing to an outer diameter of 60 mm.

The above roller is positioned to more positive order in the triboelectric charging level as compared with copy paper which is a recording material.

By using, as the pressure roller 1, a roller having a 30 μm thick PFA coating applied on an aluminum core metal of 7 mm in thickness and the above-mentioned roller as the pressure roller, both rollers were pressure contacted under a total pressure of 60 kg, and fixing treatment was conducted at a speed of 23 sheets of plain paper (A3)/min. (roller circumferential speed 270 mm/sec). As the parting agent to be impregnated into the web 6-1, 90 g per 15 m of web of a dimethyl silicone oil (KF 96H, produced by Shinetsu Kagaku Co.) having a viscosity at 25° C. of 10,000 cs was employed. The delivery speed of the web was controlled to 0.5 mm/min.

When a transferred image having 300 mg of toner image per one sheet on A3 plain paper (Canon test chart: the condition under which offset is most readily formed) was fixed under the above conditions, the toner offset percentage was 0.03% or less, without causing any problem at all. The surface potential on the pressure roller after passage of 99 sheets was found to be +6000 V or higher, the surface potential on the fixing roller −250 V and the surface potential on the paper +180 V.

The results as set forth above suggest that the offset may be reduced on account of the following factors. The pressure roller is charged highly to plus through the action of the amino-modified silicone oil mixed with silicone oil, which is the charge controllable parting agent impregnated into the pressure roller. That is, the plain paper is negatively charged, as opposed to the positive charges which should hold the negatively charged toner. Thus, negative toner is strongly hold on the paper face during fixing, whereby offset can be prevented. And, there is no scattering or disturbance of the image during fixing by virtue of the above action at all, and therefore copies of high quality could be obtained.

Then, when copying was further continued under the above conditions, the copy obtained even after passage of 100,000 sheets of paper was of high quality, not substantially changed as that at the initial stage with very small amount of offset. Besides, although the single substance of the amino-modified oil has a heat-resistant temperature of about 140° C., because it is used in this Example as a mixture with silicone oil, heat-resistance of the amino-modified silicone oil is enhanced than its single substance and therefore decomposition of amino groups will scarcely occur, and the effect can be presistent for a long term. Further, for the purpose of stabilization, it is also a preferable practice to set free the pressure roller from the fixing roller during stand-by and permit it to be pressure contacted therewith only during copying.

In the foregoing Example, a desired pressure roller was prepared by swelling a pressure roller after vulcanization with a positive charge controllable parting agent. In contrast, in this Example, it is important that the pressure roller should contain a positive charge controllable parting agent internally and on its surface. For example, approximately the same effect as in this Example can be obtained by a product obtained by adding an amino-modified silicone oil during kneading of unvulcanized rubber, followed by vulcanization.

As described above, in the present invention, in view of the electrostatic force which is a great factor for toner offset onto a rotatable member such as fixing roller, a charge controllable parting agent was added to the pressure roller, whereby it was rendered possible to obtain a fixing device capable of giving copies of high quality which is good in parting characteristic with little amount of offset for a long term. In the above Examples 5 to 9, description has been made limitedly only about the case when employing a negative toner. In the case when employing a positive toner, based on the technical thought as in this Example, in the case when the pressure roller becomes to a relatively higher potential as in the system shown in FIG. 1, a negatively charged electrification agent or charge controllable parting agent different from toner polarity may be applied on the pressure roller. Alternatively, in the case when the potential on the back face of recording material rather than the pressure roller has greater influence as in the system shown in FIG. 2, an electrification agent or charge controllable parting agent of the same polarity as the toner polarity may be applied on the pressure roller so as to give a potential of opposite polarity to toner to the back face.

Fixing is not limited only to hot roller fixing, but this Example is also applicable for a pressure fixing device. Also, for a rotatable member contacted with toner image such as the fixing roller 1, an electrification agent or charge controllable parting agent may be applied so that it may be charged to the polarity opposite to that of toner image.

Figure 10:
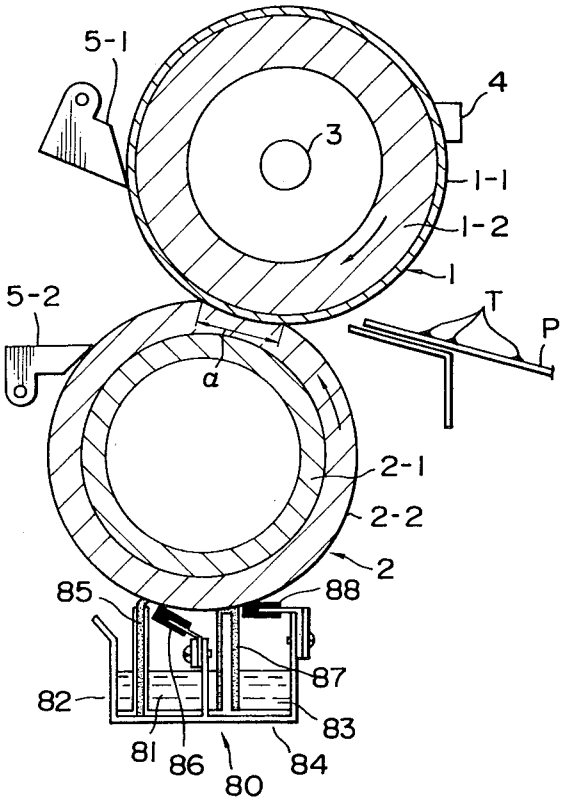
Figure 9:
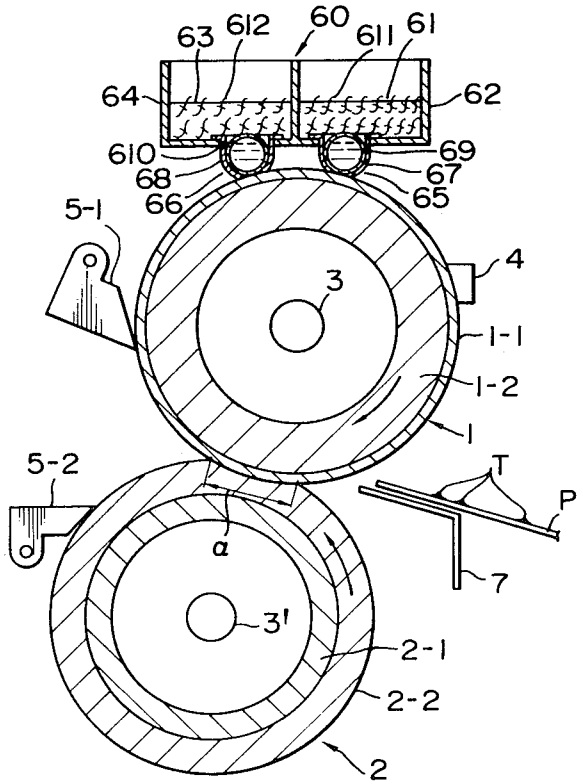

In FIG. 9, and FIG. 10, on at least one of the first and the second rotatable members, a parting agent and/or an electrification agent (particularly preferably a charge controllable parting agent) are applied, with the parting agent being applied selectively on the first rotatable member and the electrification agent (particularly charge controllable parting agent) selectively on the second rotatable member. With such a constitution, parting characteristic of the first rotatable member can be improved and the polarity of the triboelectric charging of the second rotatable member is made variable or maintained, thereby preventing very excellently the offset of a material to be fixed such as toner or resin material caused by tack or electrostatic force onto the rotatable member.

The constitutions of the fixing roller 1 and the pressure roller 2 in FIGS. 9 and 10 are the same as in FIG. 8. In the following, only the characteristic constitutions are explained.

Depicted by reference numeral 60 is an offset preventing device which prevents offset of the toner image T on a recording material onto the fixing roller 1 during fixing of the recording material.

The offset preventing device 60 has integrally a housing porton 62 for housing a charge controllable parting agent 61 as the charge controllable agent of the present invention and a housing portion 64 for housing a parting agent 63 which are separated from each other.

Further, the housing portions 62 and 64 of the offset preventing device have openings extending in the longer direction of the roller, respectively, and have in the openings 65 and 66 coating amount controlling members 65 and 66 comprising tetrafluoroethylene continuous porous members 67 and 68 including internally tetrafluoroethylene continuous porous tubes 69 and 610, respectively. And, the constitution for coating of a parting agent (63, 64, 68, 610 and 612) is set so as to be positioned at the upstream side with respect to the rotational direction of the fixing roller 1 and the constitution for coating of the charge controllable parting agent (61, 62, 67, 69 and 611) at the downstream side thereof.

Therefore, the resin layer 1-1 which is the surface of the roller 1 is coated with a minute amount of the parting agent and thereafter with a minute amount of the charge controllable parting agent. To explain briefly, the fixing roller surface has a coated layer of the parting agent 63 and a coated layer of the charge controllable parting agent 61 superposed thereon. The fixing roller surface having these coated layers permits the pressure roller 2 to be substantially coated with its upper layer of the charge controllable parting agent at the pressure coated region $\alpha$ in contact with the pressure roller 2.

This charge controllable parting agent 61 maintains the surface potential on the pressure roller 2 to be charged at the polarity for preventing offset of the toner image T.

At this time, on the surface of the fixing roller 1, offset phenomenon due to tack of the toner image is prevented, while on the surface of the pressure roller 2, offset phenomenon due to potential relation of the toner image is prevented.

That is to say, by applying thus two kinds of parting agents selectively on the fixing roller 1 and the pressure roller 2, the factors for generating offset can be precluded to a great extent.

It has already been explained that, from the above formula (1), the rollers are charged to higher potential as the thickness (R-r) is greater and/or the specific dielectric constant is smaller.

In the constitution according to this Example, the insulating coating layer on the fixing roller is relatively thin and the insulating layer on the pressure roller is relatively thick. Therefore, by controlling the triboelectric charging polarity on the pressure roller with a charge controllable parting agent as described in detail below and applying a parting agent on the fixing roller, it has been rendered possible to reduce extremely the toner offset onto the fixing roller, with an accompanying advantage of prevention of image disturbance such as scattering occurring primarily during fixing, thus enabling production of copies of high quality.

In the case as shown in FIG. 9, the toner image is of negative polarity, and by applying the parting agent 63 and the positive charge controllable parting agent 61 successively each in minute amount on the fixing roller surface, a thin film of the parting agent 63 is formed on the surface of the fixing roller 1 and the positive charge controllable parting agent is migrated to the pressure roller 2 rotating through pressure contact with the fixing roller. By reversing the triboelectric charging polarity between the pressure roller 2 having a rubber surface layer liable to be charged to a high negative potential and the copy paper with a positive charge controllable parting agent to have the pressure roller charged to a high positive potential, it has been made possible that toner offset onto the fixing roller is minimized and copies of high quality without image disturbance such as scattering are obtained.

As the parting agent 63 applicable for this art Example, all of those generally employed in the prior are available. For example, it is possible to use dimethyl silicone oil, methyl phenyl silicone oil, fluorosilicone oil or mixtures thereof.

As the charge controllable parting agent (having positive characteristic) 61, those having such a parting characteristic as described above and positioned to more positive order than the recording material in the triboelectric charging level are applicable.

To explain this Example in terms of concrete numerical values, in FIG. 9, by using, as the pressure roller 1, a roller having a 30 μm thick PFA coating applied on an aluminum core metal of 7 mm in thickness and a roller having a thermovulcanizable silicone rubber coating with a thickness of 5 mm on a stainless steel hollow core metal as the pressure roller, both rollers were pressure contacted under a total pressure of 60 kg. and fixing treatment was conducted at a speed of 23 sheets of plain paper (A3)/min. (roller circumferential speed 270 mm/sec). The permeatef flow volume V through the tetrafluoroethylene porous membrances 67, 68 in the offset preventing device is represented according to Hagen-Poiseille formula as follows:

$$V = n\pi Hr^4/ST/8nl$$

where, n: number of filter pores;
H: pressurizing force (cm $H_2O$);
r: pore diameter;
S: filter area;
T: filter time;
n: liquid viscosity;
l: film thickness$\times\sqrt{3}$.

In this Example, as the tetrafluoroethylene porous membranes 67, 68 and the tetrafluoroethylene porous tubes 69, 610, those indicated in Table 2, and Table 3 were employed (amount of parting agent 63 applied->amount of charge controllable parting agent 61 applied).

TABLE 2

| | Membrane 6-7 | Membrane 6-8 |
|---|---|---|
| Membrane Thickness (mm) | 0.2 | 0.2 |
| Pore Diameter (μm) | 0.5 | 1.0 |
| Porosity (%) | 60 | 70 |

TABLE 3

| | Tube 6-9 | Tube 6-10 |
|---|---|---|
| Tube Thickness (mm) | 2.5 | 2.5 |
| Pore Diameter (μm) | 5.0 | 5.0 |
| Porosity (%) | 85 | 85 |

As the charge controllable parting agent 61, the above-mentioned amino-modified silicone oil, having the skeltal structure of type A, a viscosity at 25° C. of 3500 cs and an amine equivalent of 2000 (KF 861, produced by Shinetsu Kagaku) was employed.

On the other hand, as the parting agent 63, a dimethyl silicone oil having a viscosity at 25° C. of 10,000 cs (KF 96H, produced by Shinetsu Kagaku) was used. On onset of copying, both rollers rotate through pressure contact, and before passing of copy paper through the rollers, the dimethyl silicone oil 63 is first fed onto the surface of the fixing roller and then the amino-modified silicone oil 61 onto the upper layer. Then, at the nip portion, most of the amino-modified silicone oil of the upper layer is migrated to the pressure roller surface. And, it is conformed that the amino-modified silicone oil once migrated to the pressure roller will not substantially be migrated back to the fixing roller in the subsequent rotations, thus being preferentially adhered on the pressure roller.

When a transferred image having 300 mg of toner image per one sheet on A3 plain paper (Canon test chart NA-2: the condition under which offset is most readily formed) was fixed under the above conditions, the toner offset percentage was 0.03% or less, without causing any problem at all.

Then, when copying was further continued under the above conditions, the copy obtained even after passage of 100,000 sheets of paper was of high quality, not substantially changed as that at the initial stage with very small amount of offset. In the above case, paper was passed at a roller surface temperature of 180° C., but the temperature of the charge controllable parting agent within the vessel 21 was about 100° C., with substantially no decomposition of amino group, whereby good results were obtained for a long time. The amount of the amino-modified consumed in the above Example was $2\times10^{-5}$ g/sheet and that of silicone oil $1\times10^{-4}$ g/sheet.

Next, as a Comparative Example, when paper passage was conducted in the same manner as this Example by use of a system in which the amino-modified silicone oils was omitted from this Example, namely the case when the parting agent 63 was applied similarly but no charge controllable parting agent was applied, the toner offset percentage was 0.6%, thus indicating 20-fold or more of toner offset onto the fixing roller as compared with this Example. Also, scattering of the image also occurred, and this was further increased as the progress of successive paper passage. This is because the surface potential on the pressure roller became greater toward the minus side as the progress of successive paper passage. And, the surface potential on the pressure roller was −6000 or more after passage of 99 sheets (about −4000 V after passage of one sheet), the surface potential of the fixing roller −200 V and the surface potential on paper +210 V.

FIG. 10 shows another embodiment of the present invention, having an offset preventing device 80 provided on the pressure roller 2 side. The same members as in FIG. 9 were indicated by the same numerals. Similarly as in the embodiment in FIG. 9, the offset preventing device 80 consists of a housing portion 82 for housing a charge controllable parting agent 81 on the upstream side with respect to the rotational direction of the pressure roller 2 and a housing portion 84 for housing of a parting agent 83 on the downstream side of the housing portion 82.

When a copy signal is input, both rollers 1 and 2 rotate, and onto the surface of the pressure roller 2 is first fed a charge controllable parting agent 81 from a heat-resistant felt 85, and then, by the metering blade 86, on the pressure roller 2 is formed a uniform thin film of the charge controllable parting agent.

Further, onto the upper layer of the above thin film is fed the charge controllable parting agent, followed by lamination of a thin film of the parting agent 83 by means of the metering blade 88 on the thin film of the charge controllable parting agent on the surface of the pressure roller. Then, at the nip portion, a part of the thin film of the parting agent 83 is migrated to the surface of the fixing roller 1. As the heat-resistant felt 85, 87 contacted against the pressure roller 2, there may be employed heat-resistant felts in general such as Nomex felt, Teflon felt and the like. As the metering blades 86, 88, contacted against the pressure roller, there may be employed heat-resistant blades in general such as fluorine rubber blade, fluorosilicone rubber blade, silicone rubber blade and the like.

In this Example, as the charge controllable parting agent 81, a mixture comprising 0.01 part by weight of an amino-modified silicone oil of the above type A having a viscosity at 25° c. of 70 cs (KF 857, produced by Shinetsu Kagaku) mixed into 100 parts by weight of a dimethyl silicone oil having a viscosity at 25° C. of 10,000 cs (KF 96H, produced by Shinetsu Kagaku) was employed. As the parting agent, a dimethyl silicone oil having a viscosity at 25° C. of 10,000 cs (KF 96H, produced by Shinetsu Kagaku) was employed.

When the same experiment was conducted as in the Example shown in FIG. 9, the toner offset percentage was 0.03% or less, and good results were obtained similarly even after paper passage of 100,000 sheets.

In this Example, the device for applying offset preventing agents was provided only on the fixing roller side or the pressure roller side, for the purpose of making it compact. However, when the parting agent applying device is provided on the fixing roller side and the charge controllable parting agent on the pressure roller side, separately, the same effect as in the above Example can be obtained. Further, this invention is applicable not only for the above heating fixing device but also for a pressure fixing device having rollers.

In the above Example, by use of a charge controllable parting agent, the charging polarity of the pressure roller having a great influence on the negative toner through contact with a recording material is reversed to stabilize its surface potential, thereby preventing greatly offset. This invention is also inclusive of the case contrary to that mentioned above, namely an example in which charging of the pressure roller is stabilized relative to the positive toner, and its surface potential change is suppressed to effect stabilization. As its specific example, when a charge controllable parting agent having a negative characteristic (e.g. parting agent containing fine powder of silica) is used in the above FIG. 9 and FIG. 10, the pressure roller will be charged negatively through friction with a recording material and it can also stand the periodical changes to maintain stable surface potential state. Thus, without recourse to changing of the polarity of the pressure roller, intensifying and stable maintenance of the polarity also promote offset prevention effect. The charge controllable agent in the above Example may preferably be endowed with parting characteristic to increase its utility, but a charge controllable agent such as an electrification agent may also be applicable.

Anyway, since a charge controllable agent or a parting agent fed is made to be adapted selectively for any of the rotatable members as described above, the surface potential of the rotatable member for fixing can be actively stabilized with good efficiency with small amount of offset over a long period time, and also the surface contamination of the rotatable member fixing (fixing roller or pressure roller, pressure belt, belt-shaped rotatable member) can be greatly prevented.

Further, according to this Example, fixed images of further higher image quality can be obtained.

Explanation of Photographs

The effect of this invention is exhibited visually here. FIGS. 11 through 29 are photographs exhibiting the results of experiments conducted under the following experimental conditions.

EXPERIMENTAL CONDITIONS

1. Machine employed:
   (trade name) CANON NP-400RE
   Copy speed A3 23 sheets/min.
   Roller circumferential speed: 270 mm/sec.
2. Constitution of fixer:
   Fixing roller (outer diameter 60 mm):
   30 μm thick PFA coating on aluminum core metal
   Pressure roller (outer diameter 60 mm):
   5 mm thick thermovulcanizable silicone rubber coating on iron core metal (rubber hardness: JISA 40 degree)
   Nip width: 8.5 mm
   Fixing roller surface temperature:
   183° C. ±0.5° C.
   Fixing heater: 870 W halogen heater
   Pressure heater: 90 W sheathed heater
3. Latent image formation:
   System: NP process (PC layer CdS)
   Condition: $V_D = +450$ V, $V_L = 0$ V (automatic control)
4. Development:
   System: Jumping development
   Condition: Clearance between S(sleeve) and D(drum): 300μ
   Clearance between S and B(blade): 240μ

$$\text{Sleeve bias}\begin{cases} V_{pp} & 1300\text{ V} \\ V_{DC} & +100\text{ V} \\ Vf & 1000\text{ Hz} \end{cases}$$

5. Toner:
   (trade name) Toner for NP-400RE
6. Paper employed:
   Canon Dry Paper (Lot. No. A3-2HH024)
7. Environment:
   23° C., 60% (Canon thermostat, humidistat chamber)
8. Chart employed:

Na-2 chart shown in FIGS. 28A, B, C at a one-to-one magnification (CANON TEST SHEET-NA2)

9. Cleaning:

Cleaning member 16 shown in FIG. 7 (web cleaning)

Web delivery speed: 2.5 mm/min.

Web pressure contact width by pressure roller 6-3: 7 mm

The above chart employed forms a large amount of and fine unfixed toner images on the paper employed. Since offset is generated at high percentage under the above experimental conditions, the web delivery speed is made faster than in Examples.

Results (1) Image

Figure 12:
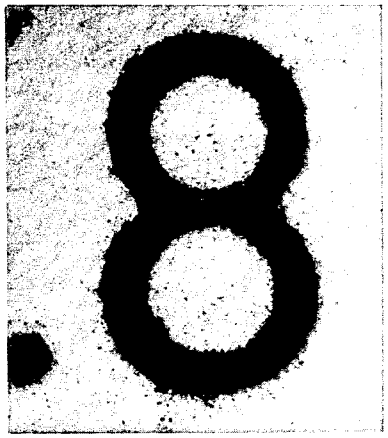
FIG. 12 PRIOR ART
FIG. 12 and FIG. 14 each show an enlarged photograph of the fixed images of the prior art.
Figure 11:
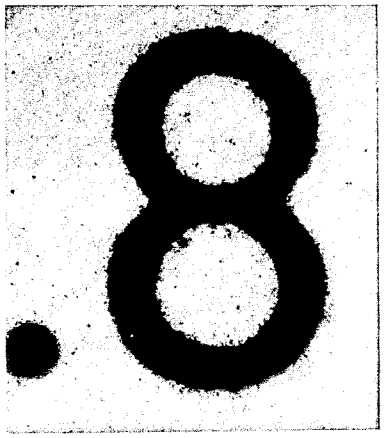
FIG. 11 and FIG. 13 each show an enlarged photograph of the image fixed by an embodiment according to the present invention.
Figure 14:
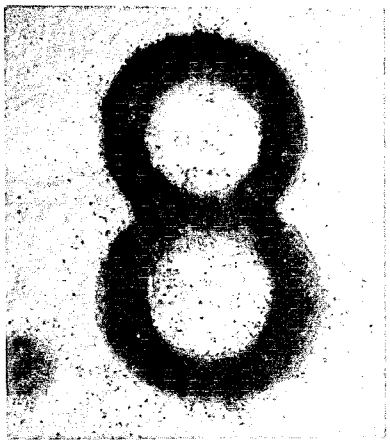
FIG. 14 PRIOR ART
Figure 13:
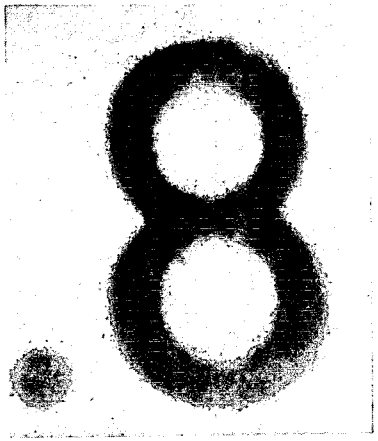

FIGS. 11 through 14 are photographs obtained by enlarged microscope photographing of one part "0.8" of "1.8" on the NA-2 chart as shown in FIG. 28B after fixing on the paper employed at a magnification of 20, followed further by close-up photographing, respectively. Among them, FIG. 11 and FIG. 13 are enlarged photographs of an example according to the present invention, namely the first and the 99th sheets, respectively, when fixed by applying only once the amino-modified silicone oil (an example of positively chargeable charge controllable parting agent) on the circumferential surface of the above pressure roller. In contrast, FIG. 12 and FIG. 14 are enlarged photographs of an example of the prior art, namely the first sheet and the 99th sheet when fixed by applying only once dimethyl silicone oil on the circumferential surface of the above pressure roller. Accordingly, by comparison between FIG. 11 and FIG. 12 or between FIG. 13 and FIG. 14, the effect of the present invention will become apparent.

To explain in detail, while in the fixed image of the prior art shown in FIG. 2, much toner is scattered around the image of "0.8", the amount of the toner scattered in the present Example is reduced to a great extent. It is difficult to judge visually these differences and such toner scatterings, but such enlarged photographs make it possible to clarify the difference in the effects. On the other hand, between FIG. 11 and FIG. 12, showing the results after passage of only one sheet, the difference in surface potential of the pressure roller is not so great. But, as the progress of fixing treatment or when successive fixing is performed, its surface potential will become greater to give rise to a clearer difference in effect. This is shown by FIG. 13 and FIG. 14.

The fixed image of the prior art shown by FIG. 14 is excessive in scattering of the image, and the image is deformed to such an extent as visually discriminable. In contrast, in the present experimental example as shown in FIG. 13, a clearer image can be obtained, and the amount of the toner scattered could be reduced to less than that in the first sheet in FIG. 1. This is because the pressure roller is maintained at a surface potential enough to urge the toner toward the side of the paper employed by the aid of the electrification agent or the charge controllable parting agent of the present invention.

(2) Offset onto the fixing roller surface

Figure 15:
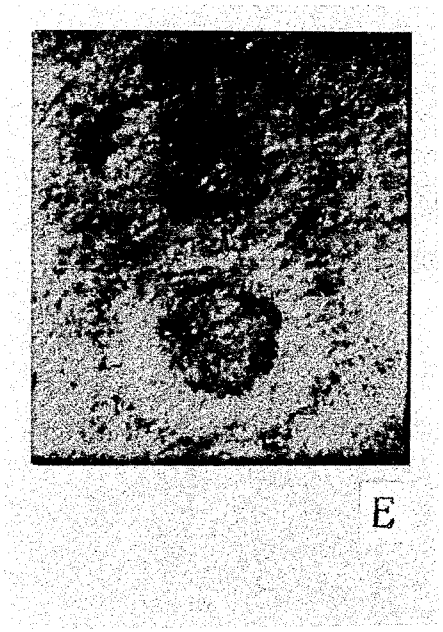
FIG. 15 PRIOR ART
FIG. 15 shows an enlarged photograph of the toner offset on the fixing roller surface of the prior art.
Figure 17:
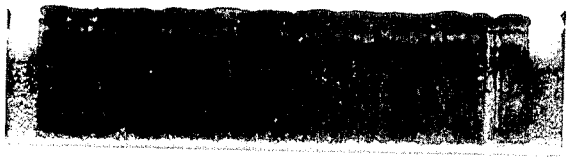
FIG. 17 PRIOR ART
FIG. 17 shows a photograph of the toner adhered to the cleaning web of the prior art and the web.

Next, FIG. 15 (prior art) is compared with FIG. 17 (present experimental example). FIG. 15 and FIG. 17 are photographs obtained by enlarged microscope photographing of samples, prepared by adhering Myler tapes on the fixing roller surface after fixing of "0.8" in FIG. 12 and FIG. 11, respectively, to have the offset toner transferred thereon, at a magnification of 20-fold, followed further by close-up photographing.

Figure 16:
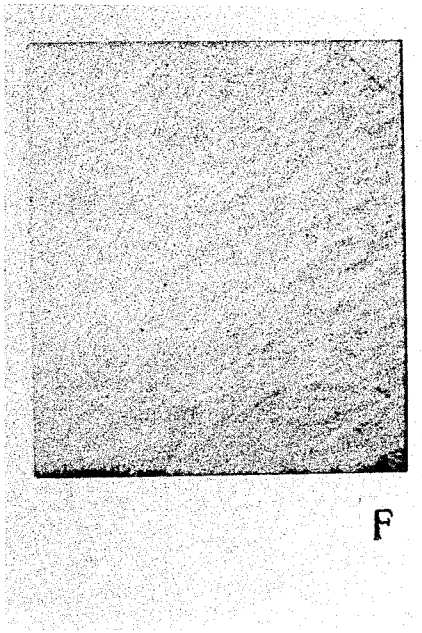
FIG. 16 shows an enlarged photograph of the toner offset on the fixing roller surface when fixed according to an embodiment of the present invention.

In the prior art example as shown in FIG. 15, the toner by far larger in amount than the image scattering as described above is attached on the fixing roller surface. This is because, the pressure roller is charged to a surface potential enough to migrate the toner image toward the fixing roller surface. In contrast, in the present experimental example as shown in FIG. 16, there is substantially no toner offset onto the fixing roller surface. That is to say, because the surface of the pressure roller surface has a surface potential enough to prevent offset, such an excellent effect can be brought about.

In the above FIG. 15 and FIG. 16, the offset condition when fixing one sheet have been shown. This tendency was also observed in successive copying. While the offset toner quantity was increased as the increase of number of successive copy sheets in the prior example as shown in FIG. 15, the result obtained was the same as in FIG. 16 according to the present experimental example.

As can be seen from the above explanation, the offset prevention effect common to all of the present inventions is very excellent as shown in FIG. 16.

(3) Offset amount during successive copying

Figure 19:
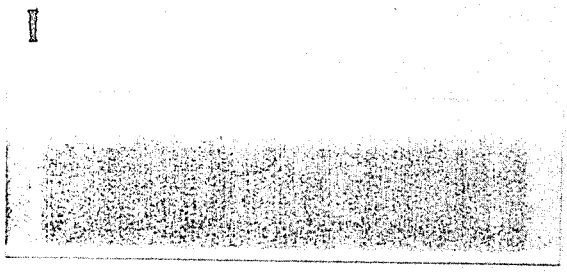
FIG. 18 through FIG. 20 each show a photograph of the toner adhered to the cleaning web when fixed according to an embodiment of the present invention and the web.
Figure 18:
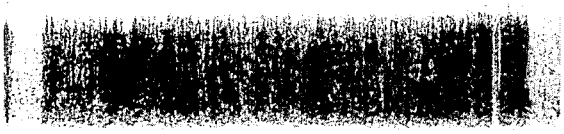
Figure 21:
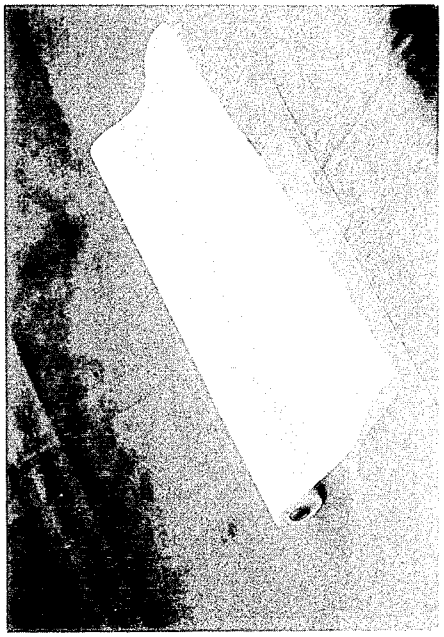
FIG. 21 shows a photograph perspectively photographed of the whole view of the cleaning web used in the present invention.
Figure 20:
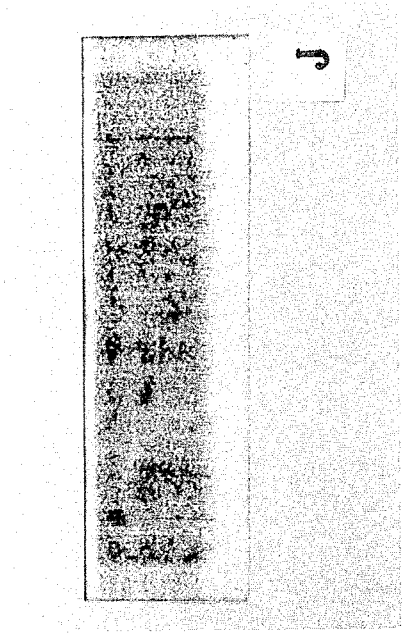

FIGS. 17 through 20 are photographs photographed at substantially real sizes of the cleaning webs laminated, after cleaning the toner amounts offset onto the fixing roller surface per unit of 100 successive sheets with the webs impregnated with dimethyl silicone oil as shown in FIG. 21. Among them, FIG. 17 is an example of the prior art, exhibiting the offset toner generated by successive copying from the first sheet to the 100th sheet by use of the above pressure roller per se. FIG. 18, FIG. 19 and FIG. 20 show the web after successive copying from the first to 100th sheets, the web after successive copying from 401st to the 500th sheets and the web after successive copying from 901st to 1000th sheets, respectively, after applying once an amino-modified silicone oil on the above pressure roller according to the present experimental example.

In the sample of the prior art shown in FIG. 17, offset toner is too much in amount, and the toner is accumulated like a mountain to such an extent as unholdable by the web. Such an accumulation is formed particularly at the wavy portion on the right side of the photograph. Although the amount of this accumulation can difficultly be seen from the photograph, but it can be judged because the web is photographed with application of a laminate. More specifically, the laminate envelopes the web so as to link the top of the mountain to the toner at the flat portion, and therefore the air appearing while intervenes between the mountains and along the slopes of mountains. By the air appearing white (primarily along the longer direction of web), the largeness of the accumulated amount can be understood. Clearly, the amount of offset toner is large in amount in FIG. 17.

In contrast, in the present experimental example shown in FIG. 18, there is no such accumulation like a mountain as shown in FIG. 19, and the offset toner amount is small as a whole. Further, even a white ground of web can be seen between the offset toners, indicating a surplous power of cleaning ability. Clearly, the excellent offset prevention effect of the present example can be evidenced.

Further, in the present experimental examples shown in FIG. 19 and FIG. 20, offset toner amount is further decreased. This indicates that the pressure roller forms a triboelectric charging surface potential sufficient for attachment of the toner image onto the side of paper employed, its greatness being gradually increased. That is to say, the electrification agent or the charge controllable parting agent applied on the pressure roller causes charging for prevention of offset through friction to bring about excellent offset prevention effect. Further, it also indicates that the offset prevention effect can be improved as more frequently used in the present invention, namely as the increase of friction.

In the case of performing successive copying according to the prior art as shown in FIG. 19 and FIG. 20, still more offset toner will be formed that the toner offset amount as shown in FIG. 17. Therefore, as the subject for comparison, only FIG. 17 was shown.

As described above, the present invention can prevent offset to a great extent, and hence it can alleviate the burden on a cleaning member such as web to be lowered also in the amount of cleaning member consumed.

(4) Comparison

Here, with respect to the burden on a web, comparison is made between the present experimental example (one coating of amino-modified silicone oil), the case only by use of the pressure roller alone and the case when a silicone oil of the trade name KF 96H is continued to be applied.

Figure 24:
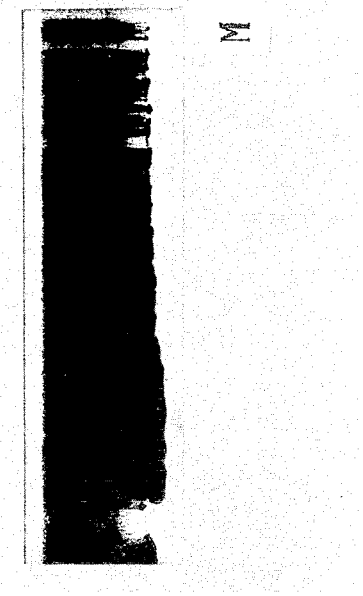
FIG. 24 PRIOR ART
FIG. 24 and FIG. 27 each show a photograph of the toner adhered to the cleaning web when fixed by means of the pressure rollers coated with silicone oil of the prior art and the web.
Figure 23:
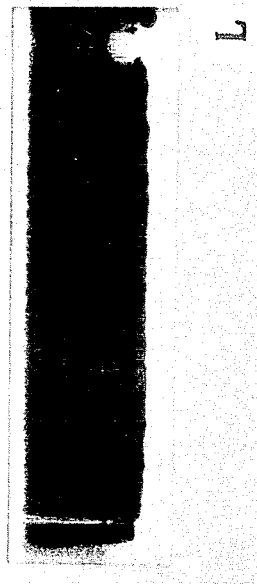
FIG. 23 PRIOR ART
FIG. 23 and FIG. 26 each show a photograph of the toner adhered to the cleaning web when fixed by means of the pressure rollers of the prior art and the web.
Figure 22:
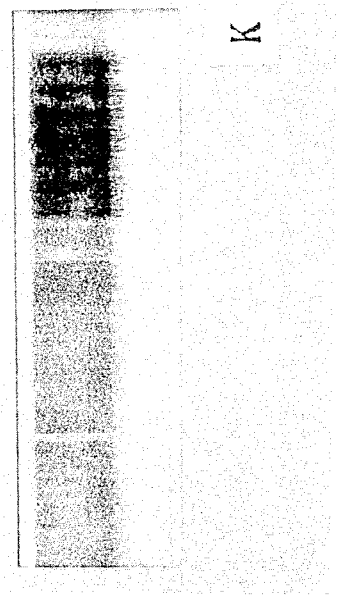
FIG. 22 and FIG. 25 each show a photograph of the toner adhered to the cleaning web when fixed according to an embodiment of the present invention and the web.
Figure 27:
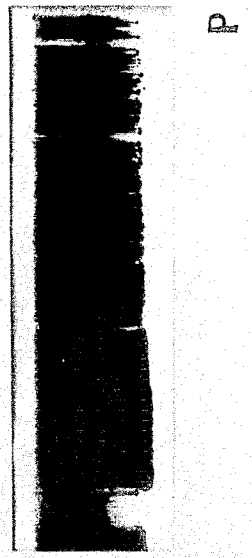
FIG. 27 PRIOR ART
Figure 26:
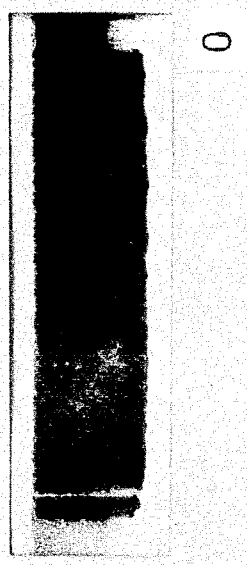
FIG. 26 PRIOR ART
Figure 25:
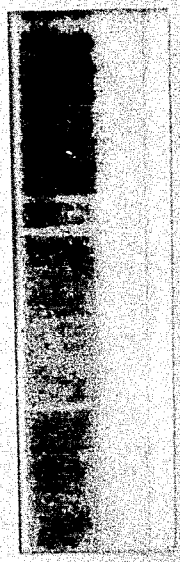

FIGS. 22 to 24 are photographs of offset toner amounts during successive copying of the 201st to 300th sheet, FIG. 22 showing the present experimental example, FIG. 23 the case when silicone oil is applied only on the pressure roller and FIG. 24 the case when silicone oil (KF 96H) is applied on both rollers. Similarly, FIGS. 25 to 27 are photographs of offset toner amounts during successive copying of the first to 100th sheets, showing respectively the present experimental example, the case when silicone oils is applied only on the pressure roller and the case when silicone oil (KF 96H) is applied on both rollers. In the experimental example shown in FIG. 22 and FIG. 25, in order to reduce the content of the amino-modified silicone oil smaller than in application of the amino-modified silicone oil previously shown in FIGS. 18 to 20, it is applied as a mixture with silicone oil.

Now, comparison is made between FIGS. 22 through 24. FIG. 24 shows the result obtained by use of a fixing device constituted so as to prevent offset by use of silicone oil of the prior art, but its offset toner amount, while a slight difference can be recognized as compared with FIG. 23, is considerably much and even an accumulation like mountain can also be observed. In contrast, in the present example shown in FIG. 22, the offset toner amount is smaller than in the foregoing examples shown in FIGS. 18 to 20, leaving considerable cleaning ability to remain. This may be considered to be due to the fact that the amino-modified silicone oil and the conventional silicone oil, while taking some form, had the effect of preventing offset synergetically through the surface potential by triboelectric charging and non-tackiness of silicone oil.

Therefore, instead of using the amino-modified silicone oil alone, it may be used as a dispersion into a parting liquid to produce further preferable effect.

Next, comparison is made between FIGS. 25 through 27. In FIG. 25 and FIG. 27, offset toner amounts are much similarly as in FIG. 23 and FIG. 24, but they are slightly smaller than in FIG. 23 and FIG. 24. This may probably be due to the slight difference in the roller surface potential because of the difference in the state of copied sheets. In contrast, in the present example shown in FIG. 25, offset toner amount is by far smaller, and the offset toner amount is less than in the case of FIG. 18. Therefore, in the state at the initial stage, it is preferred to apply an electrification agent or a charge controllable parting agent at a low concentration. Also, these effects and results can commonly be seen in the respective Examples in the specification.

As is apparent from the above description, by applying an electrification agent or a charge controllable parting agent together with a parting agent, consumption of an electrification agent or a charge controllable parting agent can be decreased with improvement of offset preventing effect.

The experiments as described in each item of the above (1) to (4) were conducted by use of CANON TEST SHEET-NA-2 shown in FIGS. 28A, B, C, and under the conditions under which offset is more liable to be generated than when employing an ordinary manuscript. Therefore, the effect according to the present invention is very great, and it is possible to provide a fixing device or rollers for fixing enriched in practical usefulness or an electrification agent (or charge controllable parting agent) applying member or an applying member having also the function of cleaning.

FIGS. 28A, B and C are cut in the order of A, B and C and attached (so as to conform to the system) from the sheet having a length in the longer direction of A3 size according to Japanese Industrial Standard. They are to be connected, at the lower part of FIG. 28A and the upper part 28B and at the lower part of FIG. 28B and the upper part 28C, respectively.

The offset toner accumulated like mountains observed in each of the above FIGS. 17, 23, 24, 25 and 27 is generated after successive copying of only some 10 sheets. The accumulated toner will not cause so much troubles if the web is moving, but it will be transferred onto the fixing roller surface during rotation of the fixing roller after the web is once stopped. Subsequently, the toner is transferred to the pressure roller, and further to the back face of the next-coming paper employed to cause back contamination on the paper employed.

Whereas, according to the present invention, such an accumulation can be prevented to a great extent and therefore such a problem can be prevented to reduce consumption of the web.

Figure 29:
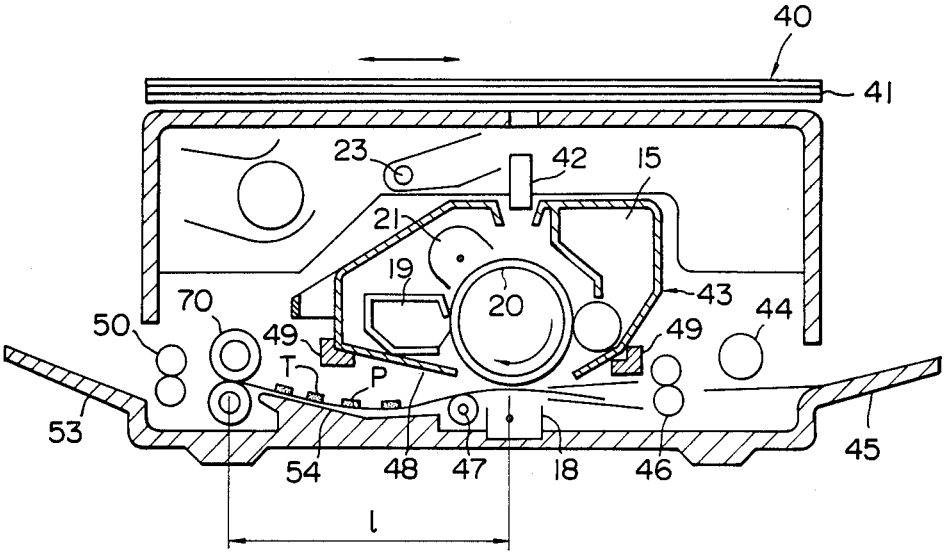
FIG. 29 is a schematic drawing for illustration of an embodiment of the present invention.
Figure 31:
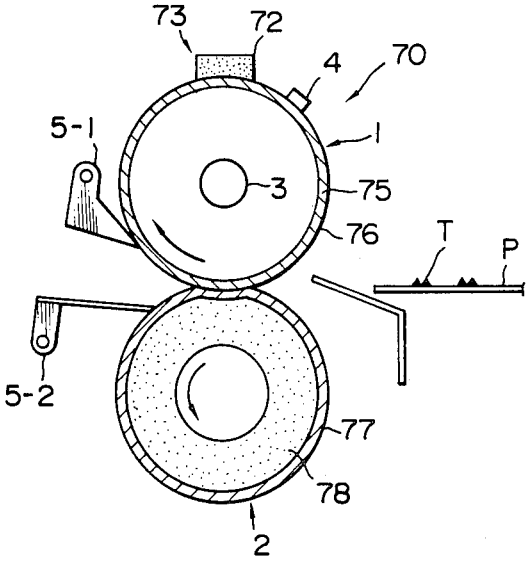
FIG. 31 is an enlarged view of the pertinent portion in FIG. 29.
Figure 30:
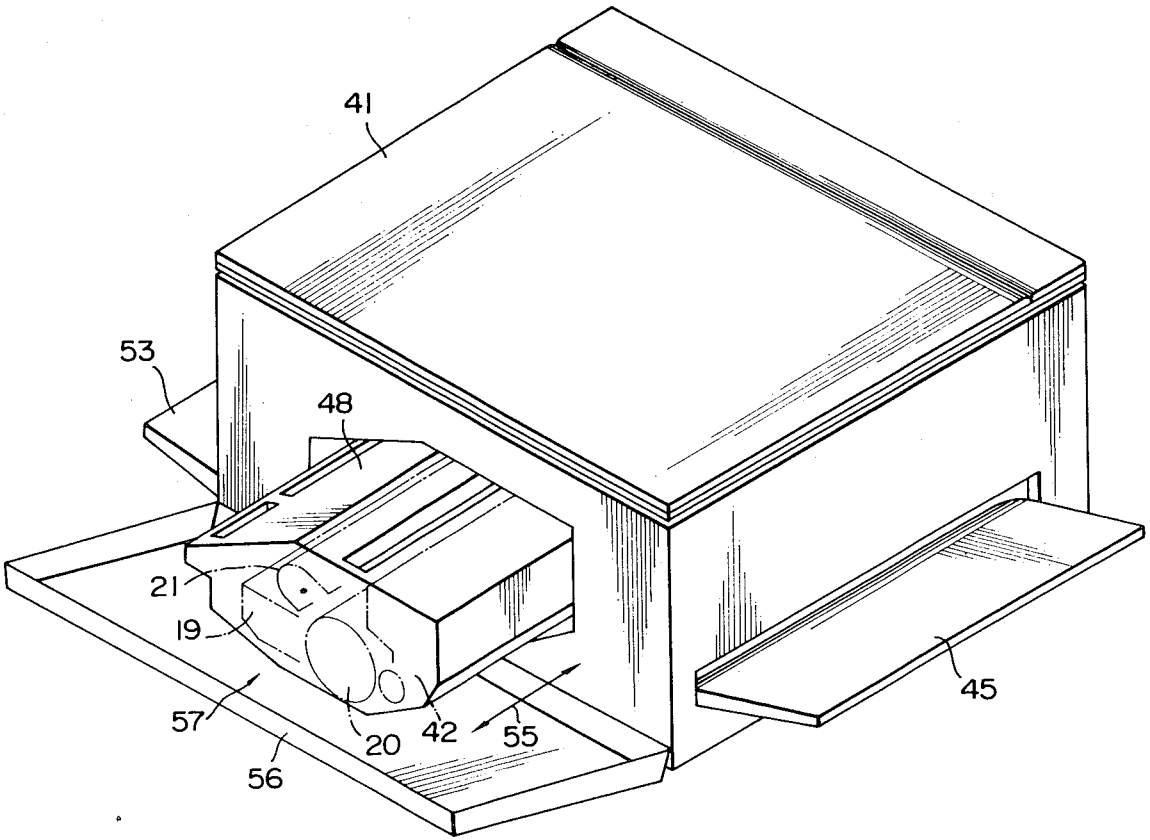
FIG. 30 is a perspective view of the embodiment shown in FIG. 29.

Referring now to FIGS. 29 to 31, among the Examples of the present invention, those of the special cases similar to the Example as shown in FIG. 3 are shown.

The present invention explained here is a device employing a recording material having a greater length than the distance between a section for forming on the entire face of a recording material by giving a polarity opposite to the specific polarity of toner image (for example, transfer portion applied to the recording material charges opposite to toner image by transfer charger) and a fixing section for fixing the toner image on the recording material, which is characterized by applying an electrification agent on the rotatable member contacted on the back face side of the toner image face thereby to apply charge control capable of giving charging to the opposite polarity to the specific polarity of the toner image on the recording material.

More specifically, similarly as in FIG. 3, the polarity of the triboelectric charging between the recording material and the rotatable member contacted with the back face side of the recording material is made the same as the polarity of toner image as a material to be fixed.

This Example is effective particularly for a minituarized recording apparatus, with such advantages that images of high quality can be obtained by prevention of image disturbance, and also that offset can be considerably prevented and the preventive effect can be maintained for a long time.

FIG. 29 shows a sectional side elevational view of the main part of an electrophotographic copying apparatus for which the above invention is applied.

In the drawing, the apparatus 40 is a copying apparatus employing electrophotographic process, and a photosensitive drum 20 having a photoconductive layer provided on an electroconductive drum substrate is axially supported so as to be rotatable in the direction of the arrow. Around the drum 20, along the rotational direction of the drum, there are arranged a corona charger 21, a short focus optical element array 42, a developing device 15, a transfer corona discharger 21 and a cleaner 19. And, in this apparatus 40, together with the photosensitive drum 20, the discharger 21, the developing device 15 and the cleaner 17 are supported integrally as a process kit 43 by a casing 48 employing an insulating and opaque dark ABS resin. The casing 48 is supported with guiding along the guide rail 49 secured to the main body side so as to be detachably mounted on the main body apparatus.

The process kit mentioned above comprises a constitutional body independent of the main body apparatus, which is constituted of one or a combination of plural numbers of process means such as a photosensitive member which is limited in repeated use numbers due to deterioration, a developing device which handles toner for which fresh supplement is required due to consumption thereof and corona discharger for which cleaning of discharging electrodes attached with toner or oxides is required, and the constitutional body made to be freely detachable relative to the main body is called as the process kit.

For example, in the above-mentioned copying apparatus, the case when N type (positive) OPC photosensitive member is used as the photosensitive drum is explained. The surface of the photosensitive drum 20 is charged uniformly with negative polarity, then the original on a reciprocating original stand 41 (or optical system may relatively move) at the upper part of the device is irradiated with a lamp, and the reflected light is exposed through the element array 42 on the drum 20 to form a negative latent image thereon. The negative latent image formed is developed with a positive toner in the developing device 15 and the developed image is transferred onto a transfer material such as plain paper by a transfer corona discharger 18 of negative polarity. The transfer material is supplied one by one by to the transfer supplying tray 45 manually by the operator, and transported through the transporting roller 44 and the timing roller 46 to the transfer section. The transfer material completed of transfer is separated by a separating means 46, delivered through a displacement pathway 54 to a fixing device 70 to be fixed thereat and further discharged through a discharging roller 50 on the discharging paper tray 53. The distance l between the transfer section 18 and the fixing section 70 is set sufficiently shorter than length of the B5 size according to Japanese Industrial Standard. As the minimum condition, it is set so that the transfer material P may reside at the same time at the transfer section and the fixing section at some time of interval. In other words, at least when the transfer material is gripped by the fixing device 17, it is under the state receiving charging of the opposite polarity to toner image at is rear end. In this Example, the process speed was controlled to 60 mm/sec.

FIG. 30 is a perspective view showing the mounting-detachment relation between the main body and the process kit 20 as described above, and the process kit including the photosensitive drum can be taken out by opening the front door of the main body and withdrawing the casing 48 manually by the operator. The arrow mark 55 in the drawing shows the moving direction with mounting and detachment of the process kit.

In FIG. 31, 1 is a fixing roller without flange having a PFA coating 76 with a thickness of 30 μm applied on an aluminum core metal 75 of 24 mm in outer diameter and 1.6 mm in thickness, 2 is a pressure roller consisting of an aluminum core metal of 14 mm in outer diameter which is coted with a thermovulcanizable silicone sponge 78 with a thickness of 4 mm and a sponge hardness (ASKER C) of 20, which is further coated on its outer circumference with a room temperature vulcanizable silicone rubber 77 with a thickness of 1 mm and a rubber hardness (JIS hardness) of 50.

Both rollers are pressured contacted with each other under a total pressure of 5 kg and rotatec cooperatively through pressure contact during copying.

The fixing roller 1 has a halogen lamp 3 of 1.1 KW mounted internally therein, and by controlling the output of the halogen lamp 3 by a temperature detecting element 4 such as thermistor contacted against the fixing roller 1 and a temperature controlling means not shown, the surface temperature of the fixing roller is controlled to an optimum temperature for fixing.

Also, by employment of the constitution according to this Example, the time from throwing of power source until the surface temperature of the fixing roller reaches the toner meltable temperature can be shortened to about 15 seconds. For this reason, even the power source may be turned off on completion of copying actuation, copying can be done in the next copying without substantial waiting (on-demand type apparatus).

Designated by reference numeral 73 is an applying member containing a charge controllable parting agent of the positive characteristic type as hereinafter described in detail, having also the function of a cleaning member, its substrate being a heat-resistant felt 73 such as Nomex, Teflon, etc.

The transfer material P such as plain paper having the positive (positive polarity) toner image T carried thereon is subjected to fixing of the toner image T by being gripped and transported between the both rollers and thereafter separated assuredly by means of the separating nails 5-1 and 5-2 arranged in contact or adjacent to the surfaces of rollers.

At this point of time, as apparently seen from FIG. 31, the fixing roller 23 is arranged to be contacted with the side supporting the unfixed toner image T of the transfer material P, while the pressure roller 24 with the back face of the transfer material P.

In this Example, the toner image T is of the positive polarity and the transfer corona discharger 18 of the negative polarity, and therefore the transfer material P enters the fixing device 70 which being charged substantially greatly of the negative polarity.

Whereas, in the fixing device 70, the rollers 1 and 2 are both under pressure contact rotation, whereby each roller surface forms a certain surface potential. When the transfer material entered the fixing device 70 under this state while receiving the actions of the above discharger, an extremely great amount of toner offset was generated.

The present inventors have made extensive studies to clarify this problem and consequently found that a great factor of this problem resides in gripping of a recording material supporting the toner image between the roller pair under the state where a means for giving continuously substantially great polarity to a toner image supporting member such as the transfer member P is acting.

That is to say, the offset phenomenon is caused, because electrostatic force due to the surface potentials of the roller pair and the recording material (paper, etc.) is greatly acting, and the present invention has been accomplished on the basis of an idea that this problem can be overcome by controlling the balance of these factors to an appropriate state according to charge control.

More specifically, according to the present invention, a triboelectric electrification agent for charging substantially a recording material, so that the recording material may support the toner image to prevent offset, is applied to the rotatable member contacted against the back face of the recording material.

In the present invention shown in FIG. 29 to FIG. 31, all of the methods may be applicable, such as the method in which an electrification agent or a charge controllable parting agent is applied on the roller surface of the fixing device; the method in which the roller surface treatment is applied; or the method in which an electrification agent or a charge controllable parting agent is added internally of the roller, but it is most preferred to employ the application method as defined in the present invention. By doing so, through charged electrostatic force, the toner offset has been dramatically reduced.

In the following, specific numerical examples are shown.

In FIG. 31, the applying member 73 comprising Nomex felt was impregnated with 1.5 g of a charge controllable parting agent, which was a mixture of 1 part of an amino-modified silicone oil having a viscosity at 25° C. of 70 cs and an amine equivalent of 830 (KF 857, produced by Shinetsu Kagaku, positive characteristic type as mentioned above) mixed into 100 parts by weight of a dimethyl silicone oil having a viscosity at 25° C. of 10,000 cs.

Under the above conditions, when fixing was conducted by use of a A4 plain paper as the tone image supporting member having 150 mg of toner image per one sheet formed thereon (the condition where offset can readily occur), the toner offset percentage was less than 0.005% without any trouble at all.

When the surface potentials during paper passage were examined, that on the paper P was −1800 V, that on the fixing roller +250 V and that on the fixing roller 24 +700 V.

As described above, in this Example, by applying a positive charge controllable parting agent from the fixing roller side, the positive charge controllable parting agent is permitted to be migrated also to the pressure roller under pressure contact rotation with the fixing roller by the time when the copy paper reaches the fixing section after commencement of copying actuation, whereby the polarity of triboelectric charging with paper of the pressure roller liable to be negatively charged can be reversed. Accordingly, while receiving transfer corona, without reducing the negative charges of the copy paper gripped and transported between both rollers, accurately by further strengthening the negative charging at the back face of the copy paper through triboelectric charging between the fixing roller and the pressure roller, the electrostatic adsorbing force between the negative charges of the copy paper and the positively charged toner image on the copy paper could be increased. Thus, toner offset onto the fixing roller could be minimized, with accompanying advantages, primarily of prevention of image disturbance such as scattering formed during fixing, to give copies of high image quality.

In the constitution according to this Example, because the potential on the pressure roller is relatively small due to slow speed and small pressure contact force between both rollers, and also because the distance between the transfer section and the fixing section is sufficiently short as compared with the length of copy paper, the potential on the paper subjected to influence from the transfer corona is relatively large even at the fixing section. For this reason, the toner offset due to electrostatic force may be approximately represented in terms of the surface potential $V_F$ of the fixing roller and the surface potential $V_P$ on the paper, by the contrast between both potentials, namely $(V_P-V_F)$, and the toner offset is smaller as the value of $(V_P-V_F)$ is greater to the minus side, while the toner offset will be greatly increased when $(V_P-V_F)$ is 0 or to the plus side.

In this Example, by the charge controllable parting agent, the pressure roller 2 was positively charged, and both rollers became to positive order relative to the copy paper in triboelectric charging level, whereby negative charges were injected into the copy paper simultaneously with negative charge injection from the negative transfer corona to charge the copy paper to a high negative potential. As a consequence, the potential contrast $(V_P-V_F)$ became −2050 V, and the positively charged toner could be closely contacted by electrostatic force with the copy paper to result in dramatic reduction of offset.

Also, in this Example, even after copying of 5,000 sheets, the effect of the charge controllable parting agent impregnated into the applying member was found to be persistent, with the toner offset percentage being less than 0.005%.

Preferably, the surface of the displacement pathway 54 should be constituted so that it may be charged through sliding movement in contact with the recording material to a potential of the opposite polarity to the potential possessed by the recording material.

For the purpose of comparison of the effect of this Example, an experiment was conducted with the following constitution.

When paper passage was performed in the same manner as in this Example using the same constitution, except for using an applying member 73 impregnated with, as the parting agent, 1.5 g of a dimethyl silicone oil having a viscosity at 25° C. of 10,000 cs (KF 96H, produced by Shinetsu Kagaku) conventionally used in the prior art, the toner offset percentage was as great as 0.06%, and toner offset occurred in so much amount unholdable by the cleaning member 27-2 after copying of about 2000 sheets that the toner which could not be cleaned was adhered to copy paper to lower markedly the copy quality. And, the toner was offset onto the fixing roller so as to effect scattering around the image portion, the copy image quality was also inferior to this Example. On the other hand, as to the surface potentials during paper passage, that on the copy paper was −450 V, that on the fixing roller −300 V and that on the pressure roller −900 V, with the potential contrast ($V_P-V_F$) being −150 V, which was still a negative potential but gave toner offset greater by 12-fold or more than this Example.

From the description as set forth above, the effect of this Example according to FIG. 29 to FIG. 31 would be confirmed.

In the above Example, when a negatively chargeable transfer corona discharger is employed for the positive toner image T, the potential of the roller pair is made to the opposite polarity to the paper, and the pressure roller 2 applies positive triboelectric charges to the paper P with the polarity of the fixing roller 1 being made the same as that of the toner image. In contrast, the reverse case is shown by the following Example.

For example, when a positively chargeable transfer corona discharger 18 is employed for the negative toner image T, a charge controllable parting agent of negative characteristic or an electrification agent of negative characteristic may be applied as shown in FIG. 31 so that the potential of the roller pair may become opposite in polarity to the paper.

In the two Examples as described above, the charge controllable parting agent was applied from the fixing roller side, but it can also be applied from the pressure roller side to obtain a similar effect.

As described above, since the distance between the transfer section and the fixing section is sufficiently short as compared with the length of copy paper (substantially at the fixing section, the toner image supporting material as a recording material receiving influence of transfer corona), this Example shown in FIG. 29 to FIG. 31 is effectively applicable for an image forming apparatus with a relatively large potential of the transfer material, having an specifically excellent offset preventing effect when the surface potential of the pressure roller is relatively small. In this Example, when the surface potential of the pressure roller is 3-fold or less as compared with the potential of the paper, the greatness of offset of toner onto the roller through the electrostatic force can be represented by the potential contrast of the fixing roller ($V_P-V_F$) as described above, while disregarding the potential of the pressure roller. As the constitution with a low surface potential of the pressure roller, there may be considered the following cases:

(1) the case when speed is slow and/or the pressure contact force between both rollers is small (generally frequently observed in low speed machines);

(2) the case of a fixing device with a constitution in which the insulating coating such as of silicone rubber or Teflon on the pressure roller is thin and the capacitance of the pressure roller is small (the surface potential of the pressure roller may be represented approximately by the formula (1) as described above); and (3) the case when the surface coating layer on the pressure roller has a low resistance (by use of a low resistance agent, etc.).

In FIG. 29 to FIG. 31, the charge controlling means may be permitted to act (addition, kneading, filling or swelling) during manufacturing of the roller, and it is also applicable for a pressure fixing device.

In the foregoing description, typical examples of various embodiments have been shown, but the present invention is applicable for various cases without limitation to the above Examples.

The basic technique of the present invention resides in that an electrification agent to be charged through triboelectric charging with a recording material to a predetermined polarity is coated, impregnated or immersed onto a rotatable member for fixing which fixes a material to be fixed such as toner image or tacky material, and that an electrical field by which the material to be fixed is held on the recording material, and or an electrostatic force by which the material to be fixed is held on the recording material, is created by utilization of the triboelectric charging.

According to this technique, without requiring a large amount of power, sufficient offset reduction effect can be exhibited even in successive fixing, and there can be obtained a clear fixed state after fixing. The surface of the rotatable member charged to a predetermined polarity with application of an electrification agent can maintain stably excellent offset preventive characteristic for a long term, and therefore this technique is economical and practical.

In the Examples of the present invention as described above, for prevention of offset phenomenon of the material to be fixed, explanations have been made by referring to applying members for coating of electrification agents or charge controllable parting agents or dispersions having these dispersed in parting agents, rotatable members for fixing or rotatable members for transporting which are impregnated or chemically combined with these agents, or fixing devices having rotatable members for fixing to which these agents are applied. The above Examples have excellent effects, respectively, but they have individually inherent characteristics.

Specifically, as for the applying member, it is simply applicable for an image forming apparatus such as a copying machine generally employed, whereby disturbance of image or offset generation can be prevented to a great extent. Particularly, in a machine of the type in which coating of a parting agent such as silicone oil is practiced, it can very easily applicable.

In the rotatable member for fixing or the rotatable member for transporting, since it has itself charging characteristics suitable for offset prevention, it can exhibit offset preventing ability without reserve. Further, it can be practically easily applicable, because excellent offset prevention can be brought about by mere exchange of rotatable member for the existing type of machine.

In the above fixing device, offset prevention can be easily done without involving other complicated devices and a number of problems to give a clearer fixed state of the material to be fixed.

In the foregoing Examples, explanation has been made separately with respect to the embodiment in which a charge controllable parting agent is contained in the surface of rotatable member and the embodiment in which an electrification agent or a charge controllable parting agent is applied on the surface of rotatable member, but a combination of these is also included in this invention, whereby more permanent offset prevention effect can be successful. Further, it is also possible to combine the constitutions of the above Examples as desired suitably for prevention of offset.

In the above Examples, the rotatable member containing a charge controllable parting agent has the excellent effect of forming a surface potential suitable for offset prevention, but it is more effective to supply an electrification agent or a charge controllable parting agent by way of coating, because durability can be enhanced thereby. When these agents are to be incorporated, it is more preferably to use a charge controllable parting agent which is chemically bound to a liquid for the purpose of attaining further uniform dispersibility.

The above Examples can be particularly effectively applied to the second rotatable member pressure contacted to the first rotatable member in the case when the first rotatable member contacted with a material to be fixed has a relatively non-active surface or a thin parting layer, and also excellent effect can be brought about in the case when the second rotatable member has an insulating layer having activity and further in the case when the insulating is thick.

The present invention can also very effectively be applied as a fixing device or rollers for fixing for an image forming apparatus having a means for transfer development of latent images with toner as described above with reference to FIG. 4, whereby scattering of images can be prevented to a great extent. As the means for transfer development, a device aparted from a latent image carrying member with a clearance which effects transfer adhesion of toner by application of alternate or/and direct current may effectively be used.

As described in detail above, the present invention has excellent effects that it can prevent offset phenomenon of a material to be fixed to a great extent and also that scattering phenomenon of the material to be fixed can be reduced to a great extent.

What is claimed is:

1. A fixing device comprising:

a first rotatable member and a second rotatable member for gripping and transporting a recording material to fix a toner image having a predetermined electric polarity onto the recording material, wherein said first rotatable member is positioned to be contactable with a face of the recording material bearing the toner image, and said second rotatable member is positioned to be contactable with a back face of the recording material, and wherein said first rotatable member and said second rotatable member each have an electrically insulating surface layer; and electrification agent applying means for applying to said second rotatable member an electrification agent which causes charging of said second rotatable member to an electric polarity opposite to the electric polarity of the toner image through a friction between the recording material and said second rotatable member, whereby the electric charge of said second rotatable member attracts the toner image to the recording material to prevent the toner image from offsetting to said first rotatable member.

2. A device according to claim 1, wherein the surface layer of said second rotatable member has a thickness larger than that of the surface layer of said first rotatable member.

3. A device according to claim 1, wherein said second rotatable member is chargeable to a potential, an absolute value of which is not less than 10 times an absolute value of a potential to which the recording material is chargeable.

4. A device according to claim 1, 2 or 3, wherein said electrification agent applying means is provided in association with said second rotatable member to apply the electrification agent to said second rotatable member.

5. A device according to claim 4, further comprising heating means for heating substantially said second rotatable member, wherein said electrification agent applying means is spaced apart from said second rotatable member and wherein said second rotatable member is expandable by heat from said heating means to an extent that the surface layer of said second rotatable member contacts said electrification agent applying means to receive the electrification agent.

6. A device according to claim 5, wherein said heating means includes a heat source mounted in said first rotatable member to supply heat to fix the toner image on the recording material.

7. A device according to claim 4, further comprising parting agent applying means provided in association with said second rotatable member, and wherein said electrification agent applying means and said parting agent applying means are disposed in the order named with respect to a direction of rotation of said second rotatable member.

8. A device according to claim 1, 2 or 3, wherein said electrification agent applying means is provided in association with said first rotatable member so that the electrification agent is applied to the surface of the second rotatable member via said first rotatable member.

9. A device according to claim 8, further comprising parting agent applying means provided in association with said first rotatable member, and wherein said parting agent applying means and said electrification agent applying means are disposed in the order named with respect to a direction of rotation of said first rotatable member.

10. A device according to claim 1, 2 or 3; wherein said electrification agent applying means functions also as means for cleaning said second rotatable member.

11. A device according to claim 1, 2 or 3, wherein said electrification agent applying means applies the electrification agent to said second rotatable member through a porous film of a fluorine resin.

12. A device according to claim 6, wherein the electrification agent includes an electrification control agent acting as a parting agent.

13. A device according to claim 1, wherein said electrification agent has an amino group.

14. A device according to claim 13, wherein said electrification agent has an amino-modified silicone oil.

15. A device according to claim 1, wherein the electrification agent has a halogen-modified silicone oil.

16. A device according to claim 1, wherein the surface layer of said first rotatable member includes a fluorine resin layer, and the surface layer of said second rotatable member includes a silicone rubber layer.

17. A fixing device comprising:

a first rotatable member and a second rotatable member for gripping and transporting a recording material to fix a toner image having a predetermined electric polarity onto the recording material, wherein said first rotatable member is positioned to be contactable with a face of the recording material bearing the toner image, and said second rotatable member is positioned to be contactable with a back face of the recording material, and wherein said first rotatable member and said second rotatable member each have an electrically insulating surface layer; and electrification agent applying means for applying to said second rotatable member an electrification agent which causes charging of said back face of the recording material to an electric polarity opposite to the electric polarity of the toner image through friction between the recording material and said second rotatable member, whereby the electric charge of the backface of the recording material attracts the toner image to the recording material to prevent the toner image from offsetting to said first rotatable member.

18. A device according to claim 17, wherein said second rotatable member is chargeable to a potential, an absolute value of which is not more than 3 times an absolute value of a potential to which the recording material is chargeable.

19. A device according to claim 17, wherein said second rotatable member includes a sponge layer underlying the insulating surface layer, and wherein the thickness of the surface layer is less than the thickness of the sponge layer.

20. A device according to claim 19, wherein the surface layer of said second rotatable member includes a silicone rubber.

21. A device according to claim 17, 18, 19 or 20, wherein said electrification agent applying means is provided in association with said second rotatable member to apply the electrification agent to said second rotatable member.

22. A device according to claim 21, further comprising heating means for heating substantially said second rotatable member, wherein said electrification agent applying means is spaced apart from said second rotatable member and wherein said second rotatable member is expandable by heat from said heating means to an extent that the surface layer of said second rotatable member contacts said electrification agent applying means to receive the electrification agent.

23. A device according to claim 22, wherein said heating means includes a heat source mounted in said first rotatable member to supply heat to fix the toner image on the recording material.

24. A device according to claim 21, further comprising parting agent applying means provided in association with said second rotatable member, and wherein said electrification agent applying means and said parting agent applying means are disposed in the order named with respect to a direction of rotation of said second rotatable member.

25. A device according to claim 17, 18, 19 or 20, wherein said electrification agent applying means is provided in association with said first rotatable member so that the electrification agent is applied to the surface of the second rotatable member via said first rotatable member.

26. A device according to claim 25, further comprising parting agent applying means provided in association with said first rotatable member, and wherein said parting agent applying means and said electrification agent applying means are disposed in the order named with respect to a direction of rotation of said first rotatable member.

27. A device according to claim 17, 18, 19 or 20, wherein said electrification agent applying means functions also as means for cleaning said second rotatable member.

28. A device according to claim 17, 18, 19 or 20, wherein said electrification agent applying means applies the electrification agent to said second rotatable member through a porous film of a fluorine resin.

29. A device according to claim 17, wherein the electrification agent includes an electrification control agent acting as a parting agent.

30. A device according to claim 17, wherein said electrification agent has an amino group.

31. A device according to claim 30, wherein said electrification agent has an amino-modified silicone oil.

32. A device according to claim 17, wherein the electrification agent has a halogen-modified silicone oil.

33. A fixing device comprising:

a first rotatable member and a second rotatable member for gripping and transporting a recording material to fix a toner image having a predetermined electric polarity onto the recording material, wherein said first rotatable member is positioned to be contactable with a face of the recording material bearing the toner image, and said second rotatable member is positioned to be contactable with a back face of the recording material, and wherein said first rotatable member and said second rotatable member each have an electrically insulating surface layer; and electrification agent applying means for applying to said first rotatable member an electrification agent which causes charging of said first rotatable member to an electric polarity the same as the electric polarity of the toner image through a friction between the recording material and said first rotatable member, whereby the electric charge of said first rotatable member urges the toner image to the recording material to prevent the toner image from offsetting to said first rotatable member.

34. A device according to claim 33, wherein said electrification agent applying means is provided in association with said first rotatable member, and the electrification agent is applied to said first rotatable member.

35. A device according to claim 33, wherein said electrification agent applying means is provided in association with said second rotatable member, and the electrification agent is applied to the surface of said first rotatable member via said second rotatable member.

36. A device according to claim 33, wherein the electrification agent includes an electrification control agent acting as a parting agent.

37. A device according to claim 33, wherein said electrification agent has an amino group.

38. A device according to claim 33, wherein said electrification agent has an amino-modified silicone oil.

39. A device according to claim 33, wherein the electrification agent has a halogen-modified silicone oil.

40. A fixing device comprising:

a first rotatable member and a second rotatable member for gripping and transporting a recording material to fix a toner image having a predetermined electric polarity onto the recording material, wherein said first rotatable member is positioned to be contactable with a face of the recording material bearing the toner image, and said second rotatable member is positioned to be contactable with a back face of the recording material, and wherein said first rotatable member and said second rotatable member each have an electrically insulating surface layer; and electrification agent applying means for applying to said second rotatable member an electrification agent which causes charging of said back face of the recording material to an electric polarity opposite to the electric polarity of toner image through friction between the recording material and said second rotatable member, whereby the electric charge of the back face of the recording material attracts the toner image to the recording material to prevent the toner image from offsetting to said first rotatable member, said fixing device being usable with an image forming apparatus wherein a toner image is formed on an image bearing member, electrostatically transferred to the recording material, and thereafter, the toner image on the recording material is fixed, wherein a distance between a station where the toner image is transferred onto the recording material and a station where the toner image is fixed is shorter than the length of the recording material measured along movement of the recording material.

* * * * *